US009500379B2

(12) United States Patent
Schnell et al.

(10) Patent No.: US 9,500,379 B2
(45) Date of Patent: Nov. 22, 2016

(54) METHODS OF DEHUMIDIFICATION CONTROL IN UNOCCUPIED SPACES

(75) Inventors: Robert J. Schnell, Plymouth, MN (US); Heidi J. Finch, Champlin, MN (US); David A. Schultz, Savage, MN (US); Cary Leen, Hammond, WI (US); Patrick C. Tessier, Oakdale, MN (US); James Grenkoski, Apopka, FL (US)

(73) Assignee: Honeywell International Inc., Morris Plains, NJ (US)

( * ) Notice: Subject to any disclaimer, the term of this patent is extended or adjusted under 35 U.S.C. 154(b) by 1267 days.

(21) Appl. No.: 12/776,133

(22) Filed: May 7, 2010

(65) Prior Publication Data

US 2010/0212879 A1 Aug. 26, 2010

Related U.S. Application Data

(63) Continuation of application No. 11/462,309, filed on Aug. 3, 2006, now Pat. No. 7,740,184.

(51) Int. Cl.

| | |
|---|---|
| ***F24F 3/14*** | (2006.01) |
| ***F24F 11/00*** | (2006.01) |
| ***G05D 22/02*** | (2006.01) |
| ***G05D 23/32*** | (2006.01) |
| ***F25B 49/00*** | (2006.01) |

(Continued)

(52) U.S. Cl.

CPC ..... *F24F 3/14* (2013.01); *F24F 11/0008* (2013.01); *F24F 11/0034* (2013.01)

(58) Field of Classification Search

CPC ..... F24F 11/0008; F24F 3/14; F24F 11/0034

USPC ..... 62/157, 158, 176.1, 176.6, 231; 165/222, 223, 230, 237; 236/44 A, 44 C

See application file for complete search history.

(56) References Cited

U.S. PATENT DOCUMENTS

| | | | |
|---|---|---|---|
| 2,438,120 | A | 3/1948 | Freygang |
| 3,469,412 | A | 9/1969 | Giuffre |

(Continued)

FOREIGN PATENT DOCUMENTS

| | | |
|---|---|---|
| EP | 045509 | 11/1991 |
| JP | 60169039 | 9/1985 |

(Continued)

OTHER PUBLICATIONS

All Non-US Patent References Have Been Previously Cited in Parent U.S. Appl. No. 11/462,309, filed Aug. 3, 2006.

(Continued)

*Primary Examiner* — M. Alexandra Elve
*Assistant Examiner* — Daniel C Comings
(74) *Attorney, Agent, or Firm* — Seager, Tufte & Wickhem, LLP

(57) ABSTRACT

Methods of providing dehumidification control in unoccupied spaces are disclosed. An illustrative method can include the steps of providing a controller having an away mode of operation adapted to provide dehumidification within the interior space of a building or room, providing one or more system components adapted to control the humidity and/or temperature within the interior space, initiating the away mode of operation within the controller, and operating the one or more system components for at least one cycle to reduce the humidity within the interior space.

14 Claims, 20 Drawing Sheets

(51) Int. Cl.

| | |
|---|---|
| ***F25D 17/04*** | (2006.01) |
| ***F25B 19/00*** | (2006.01) |
| ***F24F 6/00*** | (2006.01) |

(56) References Cited

U.S. PATENT DOCUMENTS

| | | | | |
|---|---|---|---|---|
| 3,989,097 | A | 11/1976 | Schildknecht | |
| 4,003,729 | A | 1/1977 | McGrath | |
| 4,105,063 | A | 8/1978 | Bergt | |
| 4,271,898 | A | 6/1981 | Freeman | |
| 4,318,508 | A | 3/1982 | Glasgow et al. | |
| 4,350,023 | A | 9/1982 | Kuwabara et al. | |
| 4,482,007 | A | 11/1984 | Yoshimi et al. | |
| 4,540,040 | A | 9/1985 | Fukumoto et al. | |
| 4,540,118 | A | 9/1985 | Lortie et al. | |
| 4,659,009 | A | 4/1987 | Newell, III | |
| 4,850,198 | A | 7/1989 | Helt et al. | |
| 4,884,214 | A | 11/1989 | Parker et al. | |
| 4,889,280 | A | 12/1989 | Grald et al. | |
| 4,942,740 | A | 7/1990 | Shaw et al. | |
| 5,000,382 | A | 3/1991 | Stedman | |
| 5,062,276 | A | 11/1991 | Dudley | |
| 5,065,585 | A | 11/1991 | Wylie et al. | |
| 5,114,070 | A | 5/1992 | Lilja et al. | |
| 5,129,234 | A | 7/1992 | Alford | |
| 5,192,020 | A | 3/1993 | Shah | |
| 5,224,648 | A | 7/1993 | Simon et al. | |
| 5,228,302 | A | 7/1993 | Eiermann | |
| 5,231,845 | A | 8/1993 | Sumitani et al. | |
| 5,237,826 | A | 8/1993 | Baldwin et al. | |
| 5,259,553 | A | 11/1993 | Shyu | |
| 5,261,251 | A | 11/1993 | Galiyano | |
| 5,276,630 | A | 1/1994 | Baldwin et al. | |
| 5,297,396 | A | 3/1994 | Kitamoto | |
| 5,305,822 | A | 4/1994 | Kogetsu et al. | |
| 5,311,451 | A | 5/1994 | Barrett | |
| 5,326,026 | A | 7/1994 | Jefferson et al. | |
| 5,346,129 | A | 9/1994 | Shah et al. | |
| 5,390,206 | A | 2/1995 | Rein et al. | |
| 5,419,146 | A | 5/1995 | Sibik et al. | |
| 5,427,175 | A | 6/1995 | Nagasawa | |
| 5,450,893 | A | 9/1995 | Galba et al. | |
| 5,502,975 | A | 4/1996 | Brickley et al. | |
| 5,544,809 | A | 8/1996 | Keating et al. | |
| 5,578,755 | A | 11/1996 | Offenberg | |
| 5,598,715 | A | 2/1997 | Edmisten | |
| 5,732,879 | A | 3/1998 | Low | |
| 5,911,747 | A | 6/1999 | Gauthier | |
| 5,915,473 | A | 6/1999 | Ganesh et al. | |
| 6,070,110 | A | 5/2000 | Shah et al. | |
| 6,079,121 | A | 6/2000 | Khadkikar et al. | |
| 6,427,454 | B1 | 8/2002 | West | |
| 6,478,084 | B1 | 11/2002 | Kumar et al. | |
| 6,826,920 | B2 | 12/2004 | Wacker | |
| 6,843,068 | B1 | 1/2005 | Wacker | |
| 6,892,547 | B2 * | 5/2005 | Strand | 62/176.6 |
| 6,926,079 | B2 | 8/2005 | Kensok et al. | |
| 6,996,999 | B2 | 2/2006 | Wacker | |
| 7,155,318 | B2 | 12/2006 | Sharma et al. | |
| 7,402,780 | B2 | 7/2008 | Mueller et al. | |
| 7,418,428 | B2 | 8/2008 | Ehlers et al. | |
| 7,469,550 | B2 | 12/2008 | Chapman, Jr. et al. | |
| 7,793,510 | B2 | 9/2010 | Perry et al. | |
| 8,091,375 | B2 | 1/2012 | Crawford | |
| 8,209,059 | B2 | 6/2012 | Stockton | |
| 8,280,555 | B2 | 10/2012 | Masui et al. | |
| 8,356,760 | B2 | 1/2013 | Riley, Jr. | |
| 8,467,905 | B2 | 6/2013 | George | |
| 2004/0139038 | A1 * | 7/2004 | Ehlers et al. | 705/412 |
| 2005/0270151 | A1 | 12/2005 | Winick | |
| 2007/0257121 | A1 | 11/2007 | Chapman et al. | |
| 2008/0217419 | A1 | 9/2008 | Ehlers et al. | |

FOREIGN PATENT DOCUMENTS

| | | |
|---|---|---|
| JP | 6137643 | 5/1994 |
| JP | 8156178 | 6/1996 |
| WO | 8912269 | 12/1989 |
| WO | 9322602 | 11/1993 |
| WO | 03029728 A1 | 10/2003 |

OTHER PUBLICATIONS

Cummings et al., "Executive Summary: Evaluation of the Impact of Vacant Home Space Conditioning Strategies on Summer Relative Humidity, Energy, and Peak Load; Phase II," Copyright Florida Solar Energy Center/University of Central Florida, 24 pages, Dec. 18, 2006.

Xu et al., "A New Control Algorithm for Direct Expansion Air Conditioning Systems for Improved Indoor Humidity Control and Energy Efficiency," Energy Conversion and Management, vol. 49, pp. 578-586, Sep. 17, 2007.

* cited by examiner

| ISU Parameter Number | ISU Label | Available Options | Notes |
|---|---|---|---|
| 0390 | Dehumidification Away Mode | **0 = No**<br>1 = Yes<br><br>**default is 0 = No** | • Not Shown if ISU 0379=Dehum Equipment is set to 0=None. |
| 0391 | Dehumidification Away Mode Fan Setting | **0 = Fan Auto**<br>1 = Fan On<br>2 = Fan Circulate<br><br>**default is 0 = Fan Auto** | • Shown when Dehumidification Away Mode is Set to YES.<br>• Selecting Fan On helps to remove condensation (that may build up when dehumidify with low speed fan) from the air handler and the A-Coil during the off cycle. Some humidity will be Introduced back into the living space. |
| 0392 | Dehumidification Away Mode Low Temp. Limit Setpoint | 70-80°F (21-27°C)<br><br>**default is 76°F** | • Shown when the Dehum Away Mode is set to YES.<br>• The Value of ISU 0393 is not allowed to be less than this value. |
| 0393 | Dehumidification Away Mode Temp. Setpoint | 70-99°F (21-37°C)<br><br>**default is 85°F** | • Shown when the Dehum Away Mode is set to YES.<br>• The Value is not allowed to be less than the value of ISU 0392. |
| 0394 | Dehumidification Away Mode Dehumidification Setpoint | 55-70% in Increments of 5%<br><br>**default is 65%** | • Shown when the Dehum Away Mode is set to YES. |

*Figure 10*

METHODS OF DEHUMIDIFICATION CONTROL IN UNOCCUPIED SPACES

This application is a continuation of U.S. application Ser. No. 11/462,309, filed Aug. 3, 2006, entitled "METHODS OF DEHUMIDIFICATION CONTROL IN UNOCCUPIED SPACES", which is hereby incorporated by reference.

FIELD

The present invention relates generally to the field of heating, ventilation and air-conditioning (HVAC). More specifically, the present invention relates to methods of dehumidification control in unoccupied spaces.

BACKGROUND

The air quality in unoccupied spaces such as homes, office buildings, and hotel rooms can become problematic if not regulated properly. In hot and humid climates such as Florida, for example, mold and mildew buildup can begin to occur within only a few days, particularly when the interior environment is within the psychrometric range above 72° F. and 60% relative humidity where mold spore growth is generally increased. In such climates, dehumidification is often required in order to maintain adequate indoor air quality (IAQ) levels within the interior space while the occupants are away for extended periods of time. During these relatively long periods of time, however, the occupants will often desire to conserve energy by setting the temperature at a higher level in order to reduce air-conditioner usage. A tradeoff thus exists between energy savings and sufficient humidity control.

The prevention of mold and mildew buildup in unoccupied spaces is typically accomplished using a thermostat, sometimes in series or parallel with a humidistat. Configuration of the humidistat to work in conjunction with the thermostat is often difficult since the user must make the correct settings on both the thermostat and humidistat before leaving. Since such configuration requires a specific change in setpoint and is rarely done (e.g., once a year), the steps needed to configure both the thermostat and humidistat are often difficult to remember. If the user sets the controllers incorrectly, the result can be either insufficient humidity control due to a lack of proper dehumidification, or an excessive energy bill resulting from the air-conditioner running more than is required. To assist in proper configuration, therefore, the installer of the HVAC system will sometimes paste a long list of instructions on the wall instructing the occupants how to properly set the fan switch, the system switch, the temperature setpoint, the humidity setpoint, as well as other settings while they are away.

In those cases where the HVAC system is not equipped with a separate dehumidifier, the air-conditioner can be used in lieu of the dehumidifier to regulate the humidity levels within the space. When operated as a dehumidifier, air flowing past the air-conditioning coils results in condensation on the coils, which removes water from the air and reduces the humidity levels within the space. Efforts to lower the inside temperature to reduce humidity levels within the space can be counterproductive, however, if the inside dewpoint temperature is greater than the room temperature within the interior space. If, for example, the inside dewpoint temperature within the space is 72° F. whereas the indoor temperature is 70° F., operation of the air conditioning unit may actually cause greater moisture to buildup within the space, increasing mold and mildew growth and decreasing the indoor air quality. This may occur, for example, when the temperature sensed at the thermostat is higher than that at other locations within the interior space such as the outlet ducts to the HVAC system, causing moisture to buildup on the walls adjacent to the ducts. In addition, if the cooling provided by the air conditioner exceeds the rate of dehumidification as is common in many oversized air conditioner systems, the rapid drop in temperature may cause the system to reach the dewpoint temperature before fully satisfying the humidity requirement.

SUMMARY

The present invention relates to methods of dehumidification control in unoccupied spaces. An illustrative method of providing dehumidification control within the interior space of a building or room can include the steps of providing a controller having an away mode of operation that can be used to provide dehumidification within the interior space while the occupants are away for extended periods of time. Initiation of the away mode can occur, for example, when the building or room will be unoccupied for extended periods of time and where dehumidification is necessary to prevent the buildup of mold and mildew within the interior space during hot and humid weather.

When initiated, the controller can be configured to operate one or more system components adapted to control the humidity and/or temperature levels within the interior space. In some embodiments, for example, the controller can operate an air conditioner for at least one cycle to reduce the humidity levels within the interior space when the indoor humidity is at or above an away dehumidification setting programmed within the controller. When a dehumidifier is provided, the controller can be configured to operate the dehumidifier for at least one cycle if the sensed indoor humidity within the interior space is at or above the away dehumidification setting.

The controller can be configured to determine whether the indoor dewpoint temperature within the interior space plus an offset temperature amount is greater than an away low temperature limit setting configured within the controller. If the indoor dewpoint temperature plus the offset temperature is greater than the away low temperature limit setting, the controller can be configured to operate the air conditioner to overcool the interior space at the indoor dewpoint temperature plus the offset temperature. Conversely, if the indoor dewpoint temperature plus the offset temperature is at or below the away low temperature limit setting, the controller can be configured to operate the air conditioner to overcool the interior space at the away low temperature limit setting. In use, the offset temperature amount can be used to compensate for any differences that may exist between the temperature sensed at the location of the controller and that occurring at other locations.

In those systems where a humidity sensor is not available for sensing the humidity levels within the interior space, the controller can be configured to activate the air conditioner for one or more periods of time each day to cool the interior space irrespective of the actual humidity levels within the space. In certain embodiments, for example, the controller may operate the air conditioner for two different periods of time during the day to overcool the interior space and provide the desired dehumidification.

BRIEF DESCRIPTION OF THE DRAWINGS

FIG. 10 is a table showing several illustrative programming codes for configuring the thermostat to function in the away mode of operation.

DETAILED DESCRIPTION

The following description should be read with reference to the drawings, in which like elements in different drawings are numbered in like fashion. The drawings, which are not necessarily to scale, depict illustrative embodiments and are not intended to limit the scope of the invention. Although examples of various programming and operational steps are illustrated in the various views, those skilled in the art will recognize that many of the examples provided have suitable alternatives that can be utilized. While the various methods and controllers illustrated herein are described with respect to HVAC systems, it should be understood that the present invention can be employed in other applications where dehumidification is desired.

Figure 1:
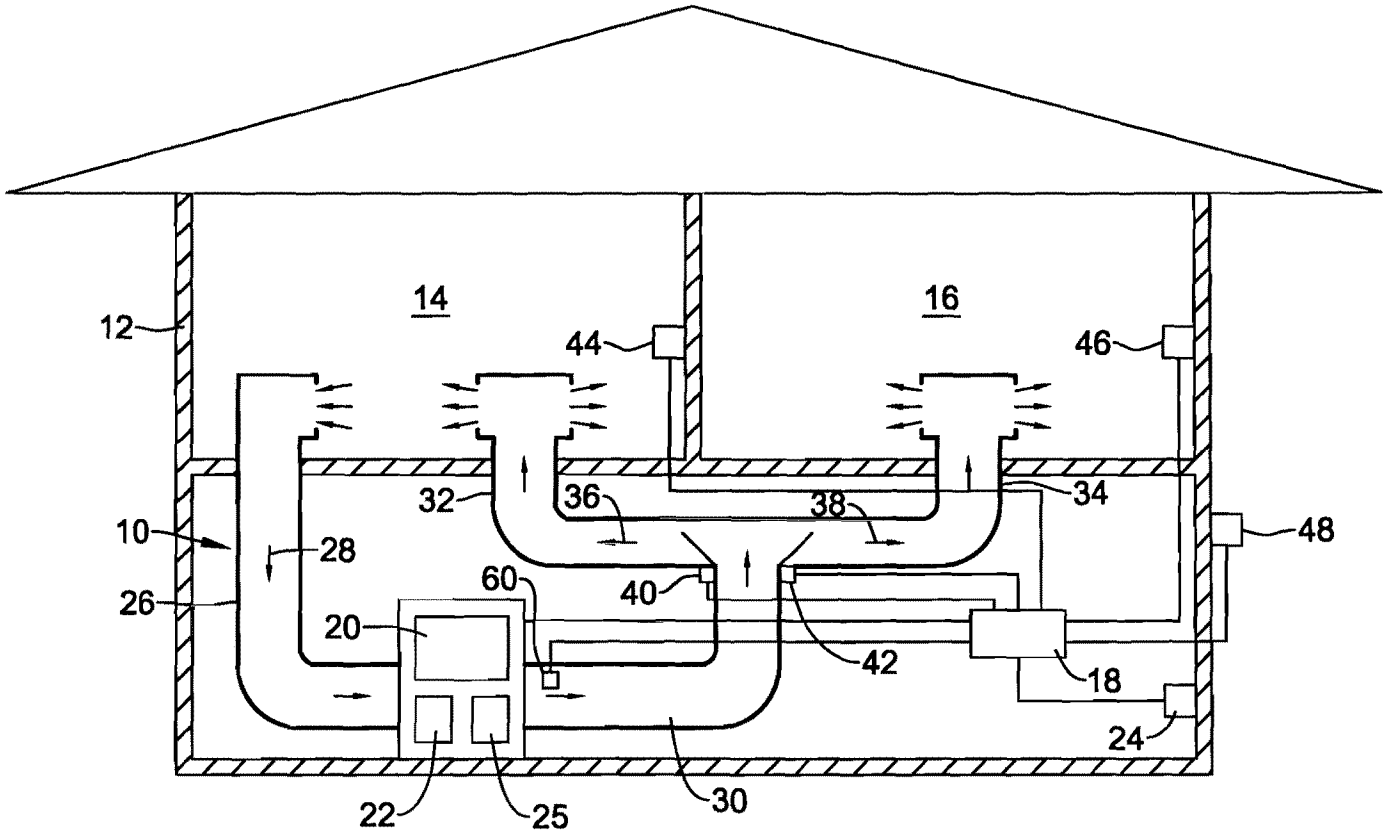
FIG. 1 is a schematic view showing an illustrative HVAC system for controlling the temperature and humidity levels within a building.

Referring now to FIG. 1, a schematic view showing an illustrative HVAC system 10 for use in controlling the temperature and humidity levels within a building 12 will now be described. The HVAC system 10, illustratively a zoned system, can include a first controlled zone 14 and a second controlled zone 16 contained within the interior of the building 12. A thermostat 18 is tasked to control a number of heating and/or cooling components, including a furnace/air conditioner 20 and an air blower or fan 22. In some embodiments, for example, the thermostat 18 can comprise a programmable setback thermostat that can be used to provide single or multistaged heating and/or cooling within the building 12 based on a programmed setpoint schedule or other control routine. The thermostat 18 can be connected to another controller such as a humidistat 24 for controlling the humidity levels within the building 12 using a dehumidifier 25, if desired.

An air intake 26 of the furnace/air-conditioner 20 can be configured to receive air from one or more of the zones 14,16 within the building 12. As shown in FIG. 1, for example, the air intake 26 can include a duct configured to receive air 28 from the first zone 14. If desired, other air intake ducts can be provided to receive air from other zones within the building 12 such as the second zone 16. A main exhaust duct 30 of the furnace/air-conditioner 20, in turn, can be connected to a number of discharge vents 32,34, which discharge conditioned air 36,38 into one or more of the zones 14,16 for heating, cooling and/or ventilating the building 12. The flow of air 36,38 through each of the vents 32,34 can be separately controlled via a number of damper mechanisms 40,42, which in addition to the fan or blower 22, can be utilized to regulate the amount of forced air 36,38 provided to each zone 14,16.

A number of internal sensors can be used to sense the temperature and/or humidity within one or more of the zones 14,16. In the illustrative embodiment of FIG. 1, for example, a first internal sensor 44 can be used to sense the temperature and/or humidity within the first zone 14 whereas a second internal sensor 46 can be used to sense the temperature and/or humidity within the second zone 16. While one sensor 44,46 is shown provided for each zone 14,16 located within the building 12, other configurations in which only a single sensor is used for multiple zones, or, alternatively, multiple sensors are used for a single zone can be implemented. If desired, one or more other sensors may be provided in one or more of the zones 14,16 for sensing other parameters within the building 12 and/or to detect the presence of specific gasses such as carbon monoxide. An external air sensor 48 can be provided to sense the ambient air temperature and/or humidity outside of the building 12.

While a multi-zoned HVAC system is shown, it is contemplated that a single-zoned HVAC system can also be implemented, if desired. Moreover, while the thermostat 18 is shown in conjunction with a forced-air system employing a furnace/air conditioner 20, it should be understood that the thermostat 18 can be used in conjunction with other types of systems. Examples of other systems can include, but are not limited to, 24 VAC systems, heat-pump systems, warm air systems, hot water systems, steam systems, radiant heat systems (e.g., in-floor and non-in-floor systems), gravity fed systems, and forced air hydronic systems.

Figure 2:
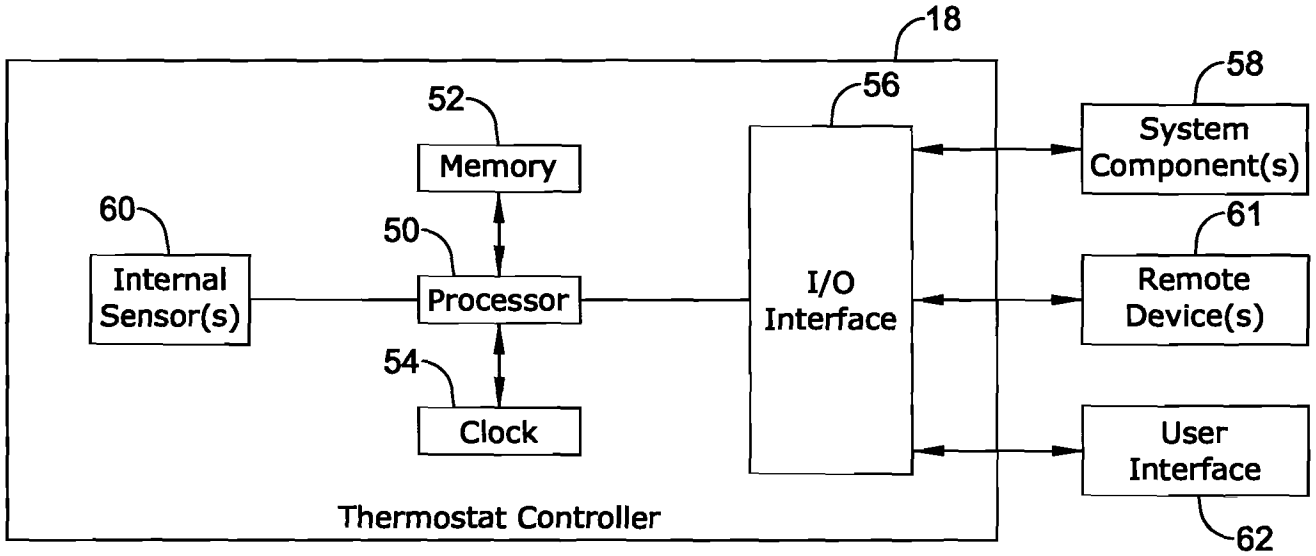
FIG. 2 is block diagram of the thermostat of FIG. 1.

FIG. 2 is a block diagram of the thermostat 18 of FIG. 1. As shown in FIG. 2, the thermostat 18 can include a processor 50 such as a microprocessor/CPU, a storage memory 52 for storing various setpoint values and user preferences, a clock 54 for maintaining the time and date, and an I/O interface 56 that connects the thermostat 18 to the various components 58 of the HVAC system. With respect to the illustrative HVAC system 10 described above with respect to FIG. 1, for example, the I/O interface 56 can be connected to the furnace/air conditioner 20, the air blower or fan 22, the humidistat 24, the dehumidifier 25, the damper valves 40,42, the internal sensors 44,46, and the external sensor 48. It should be understood, however, that the type of system components 58 connected to the thermostat 18 will typically vary depending on the configuration of the HVAC system.

An internal sensor or sensors 60 located within the thermostat 18 can be provided to sense the temperature, humidity levels and/or other environmental conditions occurring within the building at the installation location of the thermostat 18. Alternatively, or in addition, the thermostat 18 can be configured to receive temperature and/or humidity signals from a remote sensor connected to the thermostat 18 via a communications bus. For example, the I/O interface 56 can be connected to one or more remote sensors via a wired or wireless communications bus using RF signals, infrared signals, optical signals, or other suitable means for transmitting data to and from the thermostat 18.

The I/O interface 56 may further permit the thermostat 18 to be connected to one or more remote devices 61 located away from the location of the thermostat 18 to permit the thermostat 18 to be configured and/or operated remotely. In some embodiments, for example, the I/O interface 56 can include a telephone access module (TAM), RF gateway, universal serial bus (USB) port, IEEE 394 port, or other suitable communication means for providing signals to and from a remote device 61 such as another controller or a remote computer connected to the thermostat 18, allowing the thermostat 18 to be configured and/or operated from a remote location. In certain embodiments, for example, the thermostat 18 can be networked with a remote computer via a web portal, allowing the thermostat 18 to be updated by a service provider via the Internet, if desired.

The thermostat 18 can be further equipped with a user interface 62 to permit an installer to enter various inputs or commands for setting temperature setpoints, humidity setpoints, as well as other system settings. The user interface 62 can include, for example, a dial, rotor, slide, switch, button keypad, touchpad, touchscreen, computer, graphical user interface (GUI), or other means for inputting commands into the thermostat 18. The processor 50 can be configured to run a routine, which as discussed in greater detail below, can be used to operate the thermostat 18 in either a normal mode of operation for controlling the environment within the interior space during periods of occupancy, or in a dehumidification away mode of operation for controlling the environment within the interior space for extended periods of time when the interior space is unoccupied.

The thermostat 18 can include an installation or configuration mode that can be accessed by an installer or contractor via the user interface 62 to permit programming of the various thermostat settings, including those settings relating to the away mode of operation. In some embodiments, for example, the installation or configuration mode can be accessed via the user interface 62 for programming the temperature and humidity setpoints and the fan settings to be maintained while the occupant is away for extended periods of time. The thermostat 18 can also be configured to program various settings used by other controllers connected to the thermostat 18, including, for example, any humidistats used by the system to sense and/or control the humidity levels within the interior space.

Figure 3:
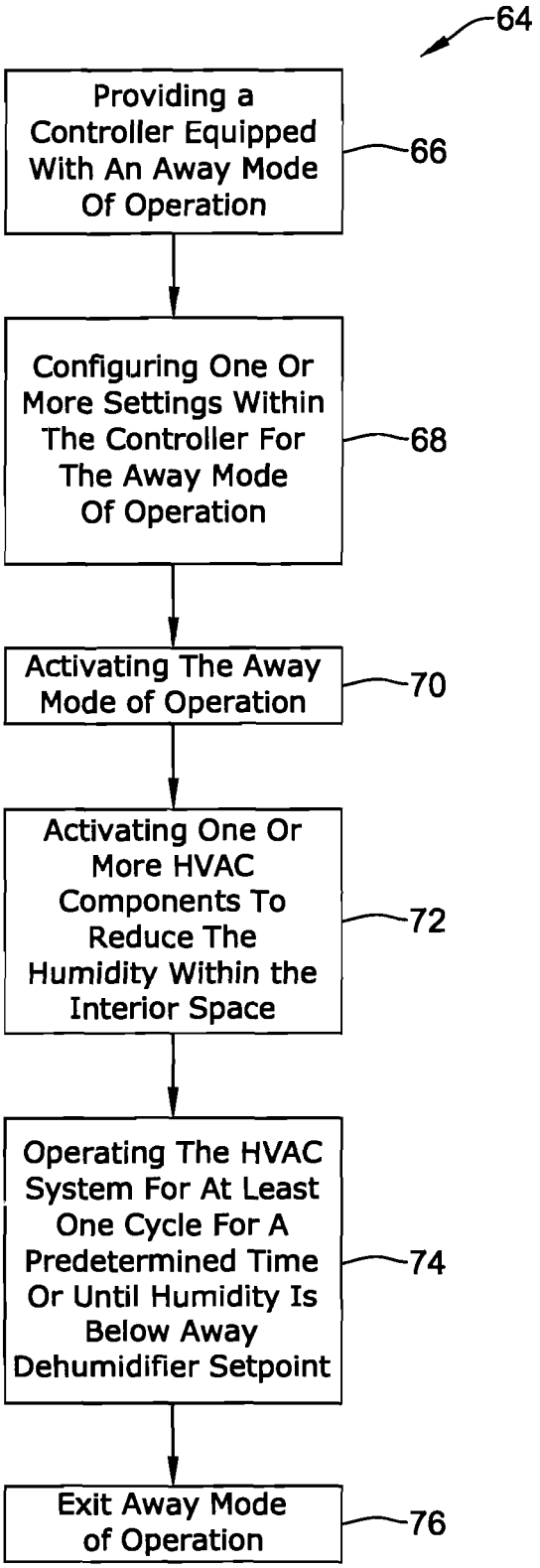
FIG. 3 is a flow diagram showing an illustrative method of providing dehumidification within an unoccupied space.

FIG. 3 is a flow diagram showing an illustrative method 64 of providing dehumidification control within an unoccupied space. As shown in FIG. 3, the method 64 may begin generally at block 66 with the step of providing a controller having an away mode of operation for providing dehumidification control within a home, office building, hotel room, or other unoccupied space to be controlled. The controller may comprise, for example, the thermostat 18 described above with respect to FIG. 2, including an interface that can be used to program various away mode settings within the controller for conserving energy while also providing adequate dehumidification control within the interior space.

During the installation process, and as shown generally at block 68, an installer may input one or more settings to the controller to configure the controller for use in the away mode of operation. Configuration of the away mode settings can occur, for example, by initiating an installation or configuration mode of the controller via the user interface, and then entering one or more parameters related to the temperature setpoint, dehumidification setpoint and/or fan settings to be used when the away mode of operation is activated. Configuration of the away mode settings can be accomplished, for example, by presenting to the installer a number of default settings pre-programmed within the controller, which can then be either accepted by the installer or adjusted by a desired amount via the user interface. In some embodiments, configuration of the away mode settings can be accomplished remotely from another device in communication with the controller.

Once the away mode of operation has been configured by the installer at block 68, the occupant may then activate the away mode of operation during extended periods of time when the interior space is unoccupied, as indicated generally by bock 70. Activation of the away mode of operation can occur manually, for example, by the user pressing a button or combination of buttons on the user interface causing the controller to switch from normal operation to the away mode of operation. Alternatively, or in addition, activation of the away mode of operation can occur automatically at preselected dates and/or times such as during the summer months while the occupant is away on extended vacation, or when no activity is sensed within the interior space for a certain period of time. In some hotel rooms, for example, activation of the away mode of operation can occur automatically when no movement is detected within the hotel room for a period of several days or weeks, indicating that the hotel room will likely continue to be vacant for an extended period of time.

Once the away mode of operation has been activated at block 70, the controller at block 72 can be configured to activate one or more HVAC system components in order to provide dehumidification control within the interior space while also conserving energy usage. In those systems employing a dehumidifier, for example, the controller can be configured to automatically change the system to operate in a cooling mode, and then operate the dehumidifier at a dehumidification setpoint that is different than that used during the normal mode of operation to provide dehumidification. In those systems without a dehumidifier, the controller can be configured to automatically change the system to operate in a cooling mode, and then operate the air conditioner at a temperature setpoint that is different than that used during the normal mode of operation to provide overcooling within the interior space when dehumidification is desired.

During the away mode of operation, the controller can be configured to operate the HVAC system for at least one cycle in order to maintain the humidity levels within acceptable limits, as indicated generally by block 74. When a dehumidifier is present, for example, the controller can be configured to activate the dehumidifier for at least one cycle during the day to control the humidity levels within the interior space while activating the air conditioner if the temperature within the space is at or greater than an away temperature setpoint programmed within the controller. In those systems without a dehumidifier or where the dehumidifier is disabled or is not a whole-house dehumidifier, the controller can be configured to operate the air conditioner to overcool the interior space and maintain the humidity levels at or below an away dehumidification setpoint programmed within the controller.

In those embodiments where a humidity sensor is provided, the controller can be configured to operate the dehumidifier and, in some cases also the air conditioner, until the humidity levels within the interior space are below the away dehumidification setpoint programmed within the controller. If the system is not equipped with a humidity sensor, or if a dehumidifier is not provided or is disabled, the controller can be configured to operate the air conditioner for a predetermined period of time during each day sufficient to reduce the humidity within the interior space. When the away mode of operation is active, and in some embodiments, the controller can be configured to default to a cycles per hour (CPH) setting of "1" for all cooling stages, forcing longer compressor on times to increase moisture removal via the air conditioner coils.

As indicated generally at block 76, the user may then exit the away mode of operation at any time during the routine, causing the controller to resume its normal mode of operation.

Figure 4:
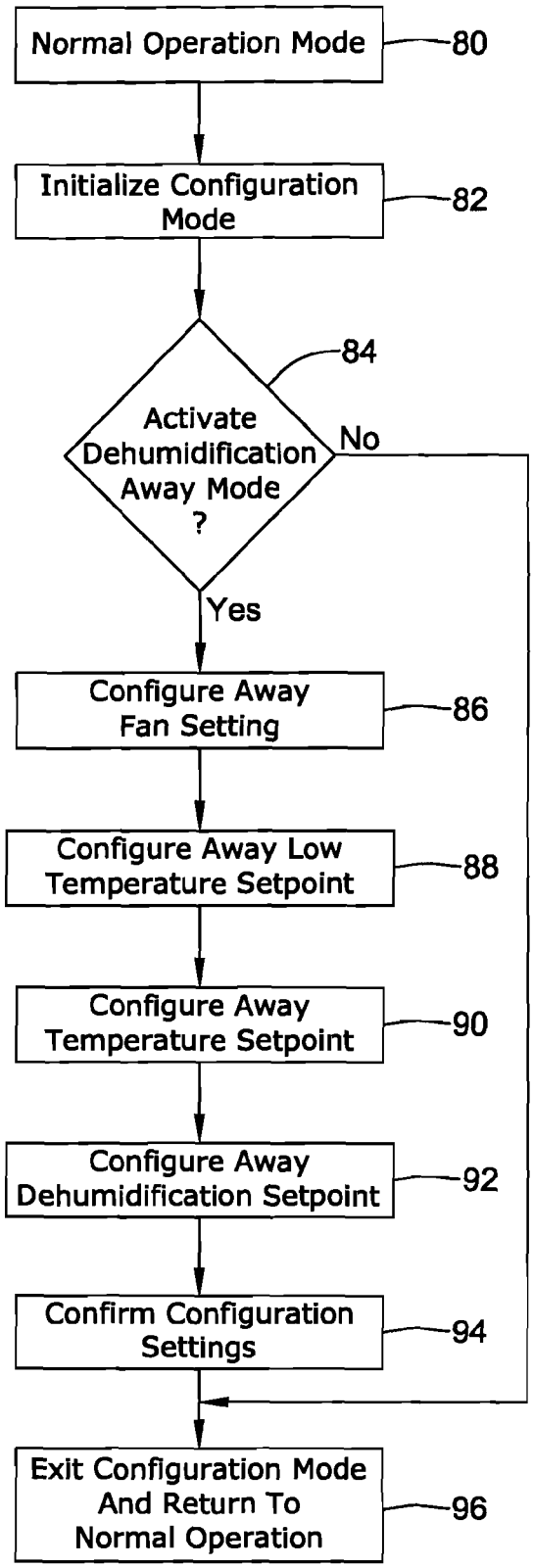
FIG. 4 is a flow diagram showing several illustrative steps of configuring a controller for use in an away mode of operation.

FIG. 4 is a flow diagram showing several illustrative steps of configuring a controller for use in an away mode of operation. As shown in FIG. 4, configuration of the controller can begin generally at block 80 with the controller initially operating in a normal mode of operation. Initiation of the configuration mode can occur at block 82 when an installer selects a button or combination of buttons on the user interface. In some embodiments, initiation of the configuration mode can occur automatically when the installer initially configures the controller for the first time, or when a signal is received from another device in communication with the controller.

Once initiated, the controller may prompt the installer to select whether to activate the away mode of operation, as indicated generally at block 84. If the installer indicates a "no" response at block 84, the controller can be configured to exit the away configuration mode and return to normal operation, as indicated generally at block 96. Conversely, if the installer indicates a "yes" response at block 84, the controller may continue the configuration routine and prompt the installer to select the fan setting to be used during the away mode of operation, as indicated generally at block 86. In certain embodiments, for example, the controller may prompt the installer to select between a "fan auto" fan setting that causes the fan to cycle on and off automatically when other system components such as the air conditioner are activated, a "fan on" fan setting that causes the fan to continually operate while the controller is operating in the away mode, or a "fan circulate" fan setting that causes the fan to operate when circulation is desired. In some embodiments, the controller can be configured to default to a particular fan setting such as "fan auto", which can then be changed via the user interface if the installer desires the fan to operate differently during the away mode of operation.

The controller may further prompt the installer at block 88 to configure a low temperature setpoint to be used as a lower temperature limit by the controller during operation in the away mode. In some embodiments, for example, the controller may prompt the installer to select a low temperature limit setpoint from a range of temperature settings between 70° F. and 80° F. In some cases, the controller can provide the installer with a default low temperature limit setpoint such as 76° F., which can then be changed by the installer, if desired. During operation, the away low temperature limit setpoint can be used by the controller to provide overcooling within the interior space below the away temperature setpoint for lowering the humidity levels within the space when a dehumidifier is not present or on-line, or if a dehumidifier is present but is insufficient to provide the necessary dehumidification.

Once a lower temperature limit has been set at block 88, the controller may next prompt the installer at block 90 to configure an away temperature setting that can be used by the controller to maintain the temperature within the interior space during operation in the away mode. In some embodiments, for example, the controller may prompt the installer to select an away temperature setpoint from a range of temperature settings between 70° F. and 99° F. In some cases, the controller can provide the installer with a default temperature setpoint such as 85° F., which can then be changed upwardly or downwardly by the installer, if desired.

The controller may next prompt the installer at block 92 to select a desired dehumidification setting to be used by the controller for maintaining the humidity levels within the interior space during the away mode of operation. In some embodiments, for example, the controller may prompt the installer to select an away dehumidification setpoint from a range of settings between 55% relative humidity and 70% relative humidity. As with the fan and temperature settings, the controller can provide the installer with a default away dehumidification setpoint such as 65%, which can then be adjusted either upwardly or downwardly by the installer, if desired.

Once the installer has configured the fan, temperature, and dehumidification settings at blocks 86 though 92, the controller can be configured to prompt the installer to confirm the newly programmed settings at block 94 and then exit the configuration routine at block 96, causing the controller to return to normal operation.

Figure 5A:
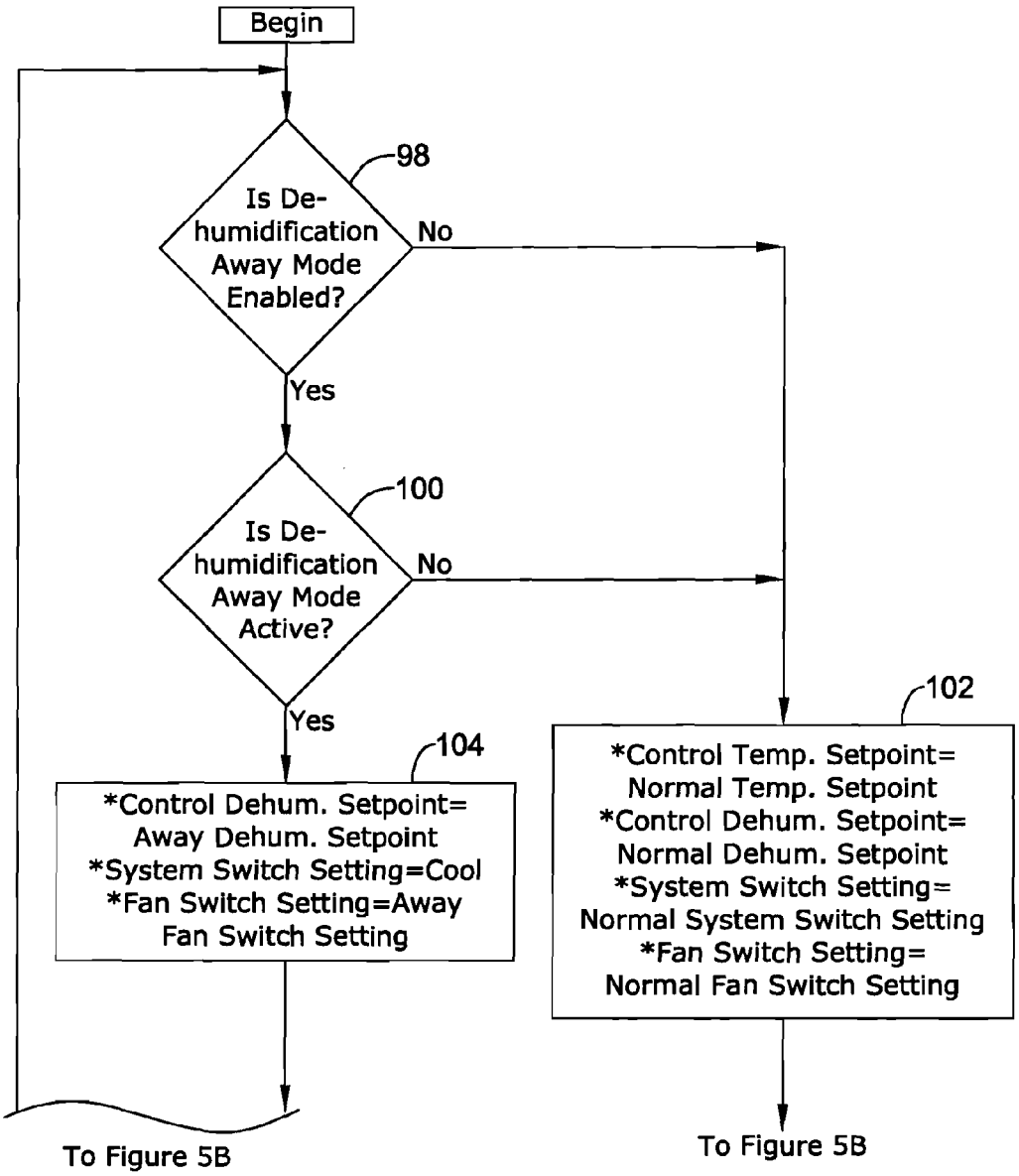
FIGS. 5A and 5B are logic diagrams showing several illustrative steps for controlling the dehumidification within an interior space using a controller equipped with an away mode of operation.
Figure 5B:
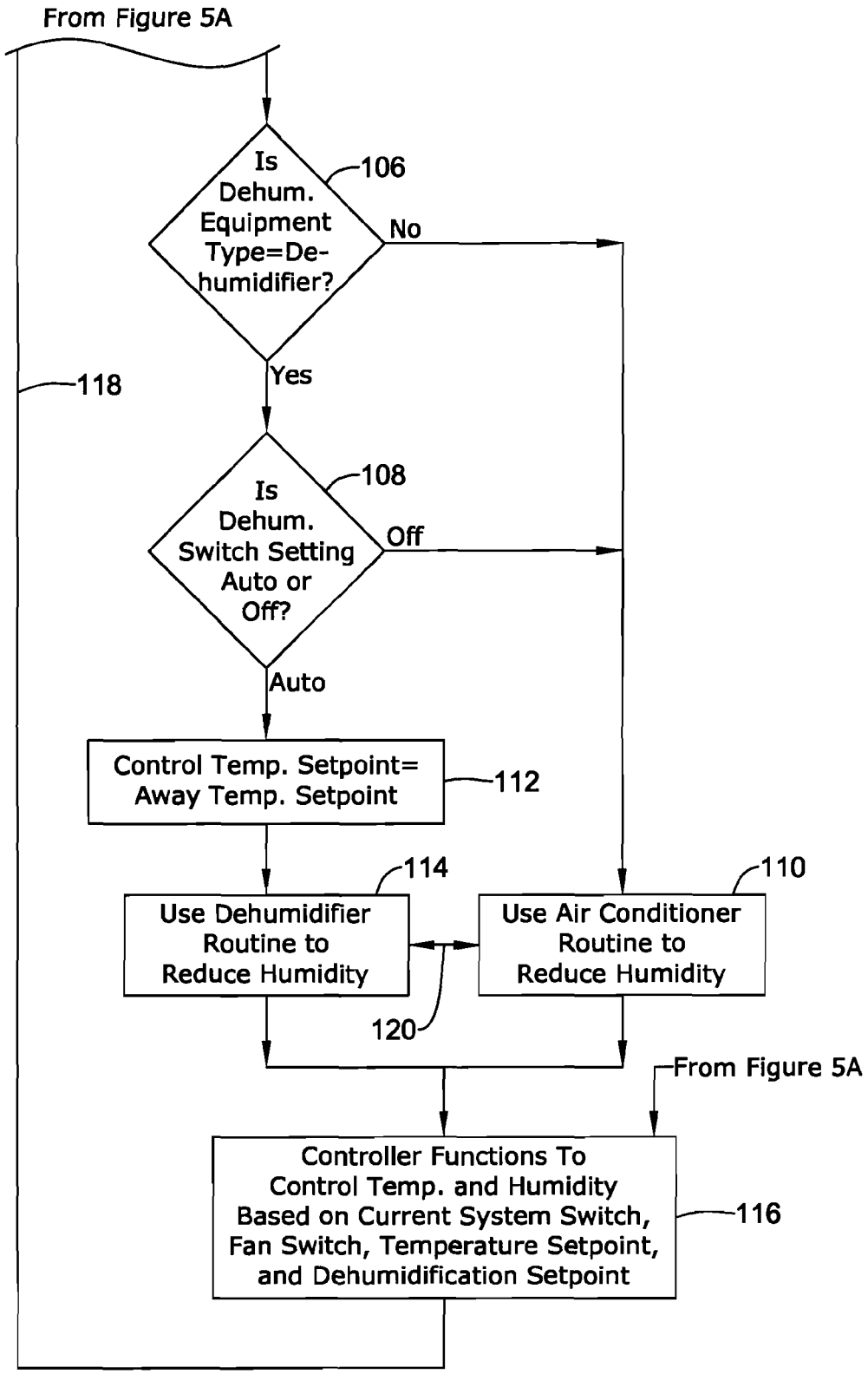

FIGS. 5A and 5B are logic diagrams showing several illustrative steps for controlling the dehumidification within an interior space using a controller equipped with an away mode of operation. Beginning at blocks 98 and 100 in FIG. 5A, the controller can be configured to determine whether the dehumidification away mode has been enabled and is currently active. If, for example, at either block 98 or 100 the controller determines that the away mode is disabled and/or deactivated, the controller can be configured to operate the system components using their normal settings, as indicated generally by block 102. For example, if the controller determines that the away mode is deactivated at block 100, the controller can be configured to operate the system using the normal temperature and dehumidification setpoints and the normal fan and system settings programmed within the controller.

If at decision block 104, however, the controller determines that the away mode of operation is currently active, the controller can be configured to default to the cool system setting and then operate the system components using the away mode settings, as indicated generally by block 104. For example, when the away mode of operation is active, the controller can be configured to operate the system components using the away mode settings discussed above with respect to FIG. 4, including the away fan setting programmed at step 86, the away low temperature limit setpoint programmed at step 88, the away temperature setpoint programmed at step 90, and the away dehumidification setpoint programmed at step 92. If these settings have not been previously programmed, the controller can be configured to suggest default settings for operating the system in the away mode, or can be configured to initiate the configuration routine and prompt the user to configure the away mode settings within the controller. In some cases, if the settings have not been previously programmed, the controller can be configured to receive one or more programming signals from a remote device connected to the controller, allowing the controller to be programmed remotely by a servicing contractor.

As can be further seen in FIG. 5B, the controller can determine at decision blocks 106 and 108 whether a dehumidifier is available, and, if so, whether the dehumidifier is currently on-line. If the controller determines that a dehumidifier is not available or is currently off-line, the controller can be configured to control the humidity levels within the interior space using an air conditioner routine, as indicated generally by block 110. Conversely, if the controller determines that the dehumidifier is available at block 106 and is set to "auto" at block 108, the controller can be configured to change the temperature setpoint to the away temperature setpoint at block 112, and then use a dehumidifier routine to control the humidity levels within the interior space, as indicated generally by block 114. Using either the air conditioner routine at block 110 or the dehumidifier routine at block 114, the controller then seeks to maintain the temperature and humidity levels at the away mode settings programmed within the controller, as indicated generally by block 116. The controller can then be configured to continuously or periodically repeat the query process, as indicated generally by arrow 118.

In some embodiments, and as further illustrated by arrow 120 in FIG. 5B, the controller can be configured to provide dehumidification within the interior space using both the dehumidifier and air conditioner. If, for example, operation of the dehumidifier is insufficient to maintain the away dehumidification setpoint programmed within controller after a certain period of time has elapsed (e.g., after 6 hours of dehumidifier operation), the controller can be configured to activate the air conditioner for a period of time to overcool the interior space in order to achieve the away dehumidification setting. In some embodiments, the controller can be configured to operate the fan or blower in a low speed fan mode, reducing the speed of the fan or blower to increase the period of time that the air contacts the air conditioner coils. When a whole-house dehumidifier is not used, for example, such reduction of the fan or blower speed can increase the amount of condensation on the air conditioner coils, further reducing the humidity levels within the interior space.

Figure 6:
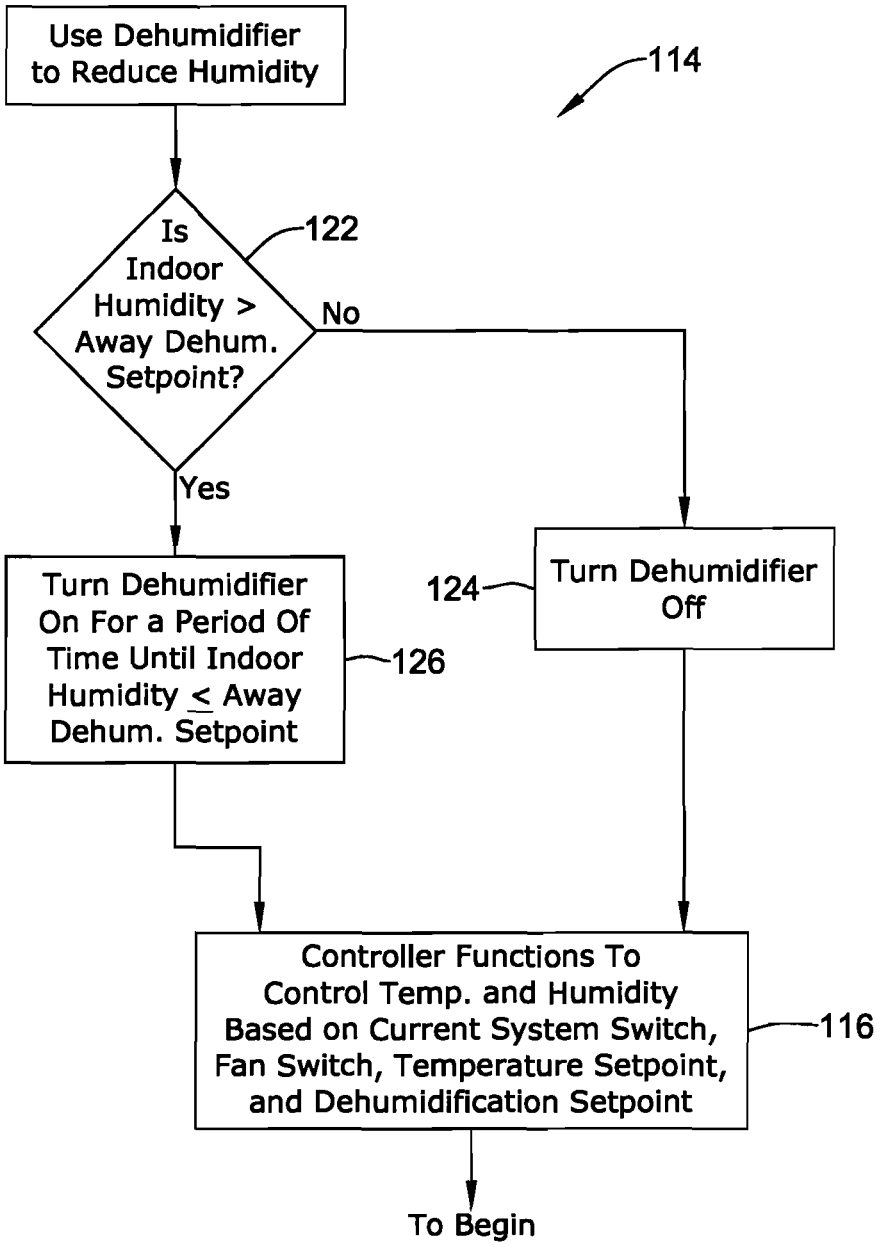
FIG. 6 is a logic diagram showing several illustrative steps for controlling the dehumidification within an interior space using a dehumidifier to reduce humidity.

FIG. 6 is a logic diagram showing several illustrative steps for controlling the dehumidification within an interior space using the dehumidifier routine 114 of FIGS. 5A and 5B. As shown in FIG. 6, when the dehumidifier is enabled and is on-line, the controller can be configured to monitor the humidity levels within the interior space to determine whether the indoor humidity is greater than the away dehumidification setpoint, as indicated generally at block 122. If the indoor humidity is at or below the away dehumidification setpoint, the controller can be configured to shut-off the dehumidifier at block 124, and then operate the system using the current temperature and humidity setpoints and the current fan and system settings at block 116. Conversely, if the indoor humidity is greater than the away dehumidification setpoint at block 122, the controller can be configured to turn the dehumidifier on at block 126 for a period of time until the indoor humidity within the interior space reaches the away dehumidification setpoint.

Figure 7:
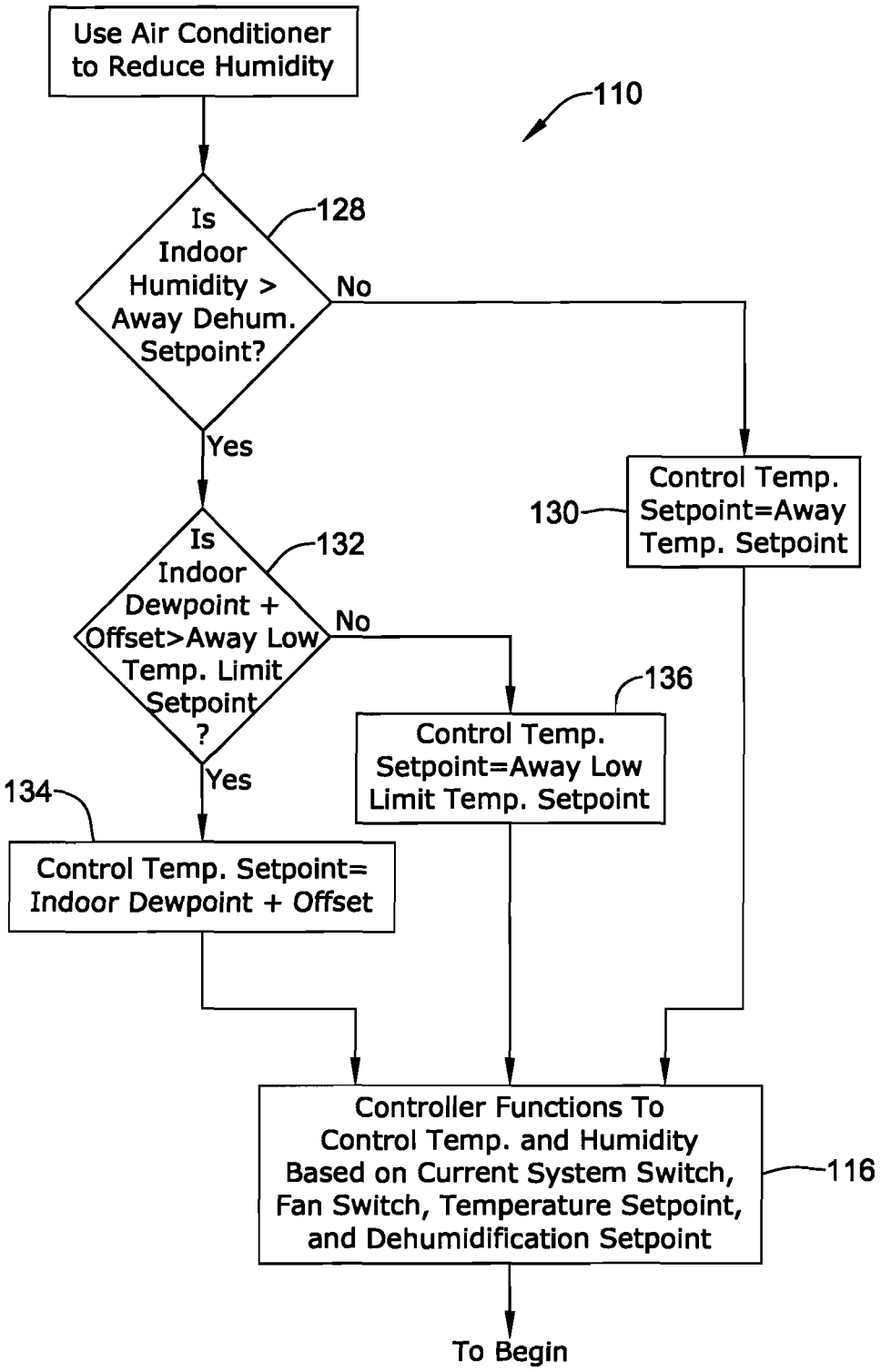
FIG. 7 is a logic diagram showing several illustrative steps for controlling the dehumidification within an interior space using an air conditioner to reduce humidity.

FIG. 7 is a logic diagram showing several illustrative steps for controlling the dehumidification within an interior space using the air conditioner routine 110 of FIGS. 5A and 5B. As shown in FIG. 7, when the air conditioner is tasked to provide dehumidification, the controller can be configured to monitor the humidity levels within the interior space to determine whether the indoor humidity is greater than the away dehumidification setpoint, as indicated generally at block 128. If the indoor humidity is at or below the away dehumidification setpoint, the controller can be configured to cool the interior space using the away temperature setpoint, as indicated generally at block 130. If, on the other hand, the indoor humidity is greater than the away dehumidification setpoint, the controller at block 132 can be configured to determine whether the indoor dewpoint temperature plus an offset amount such as 5° F. is greater than the away low temperature limit setpoint. Such temperature offset may be used, for example, to compensate for the temperature differential that can sometimes occur by sensing the temperature at the controller instead of at another location such as at the outlet ducts where cool air is discharged into the space.

If at block 132 the controller determines that the indoor dewpoint temperature plus the offset temperature is greater than the away low temperature limit setpoint, the controller can be configured to control the temperature setpoint at the indoor dewpoint temperature plus the offset, as indicated generally by block 134. If at decision block 132, for example, the away temperature setpoint is 85° F. and the sensed indoor dewpoint temperature plus the offset is 83° F. (i.e., 78°+5°), the controller can be configured to control the temperature at the offset temperature setpoint of 83° F. to prevent moisture buildup. Conversely, if at decision block 132 the indoor dewpoint temperature plus the offset temperature is at or below the away low temperature limit setpoint, the controller can be configured to control the temperature at the away low temperature limit setpoint programmed within the controller, as indicated generally by block 136.

Figure 8:
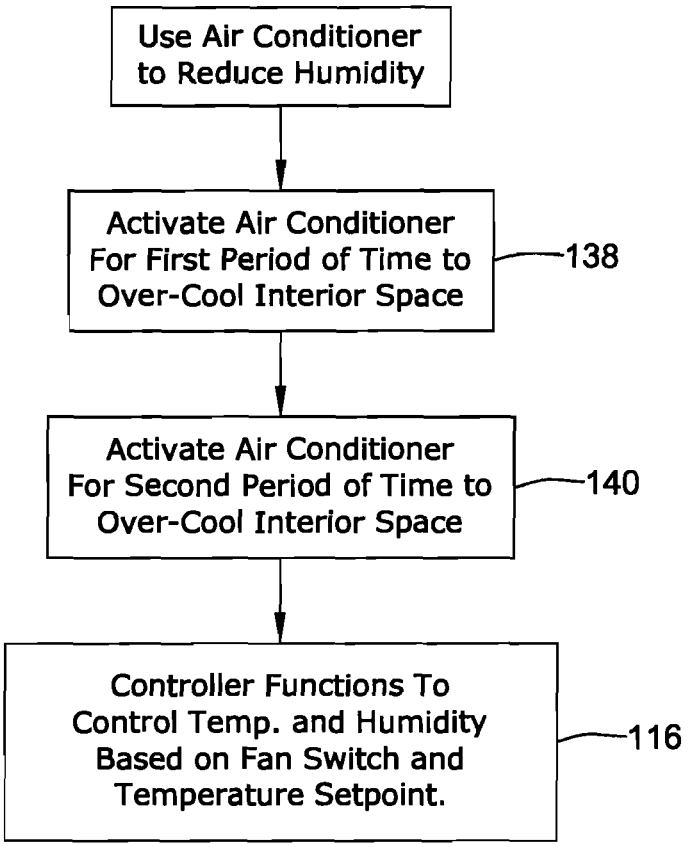
FIG. 8 is a logic diagram showing several illustrative steps for controlling the dehumidification within an interior space when a humidity sensor and dehumidifier are not available.

In those systems where a humidity sensor is not provided to sense the indoor humidity levels within the interior space, the controller can be configured to control the operation of the air conditioning unit for one or more periods of time each day in order to overcool the interior space and provide dehumidification during the away mode of operation. In one such embodiment depicted in FIG. 8, for example, the controller can be configured to activate the air conditioner one or more times each day in order to overcool the interior space and reduce the humidity levels therein irrespective of the actual humidity levels within the space. In certain embodiments, for example, the controller can be configured to activate the air conditioner for a first period of time each day to overcool the interior space and provide dehumidification, as indicated generally by block 138. The controller may further activate the air conditioner for a second period of time each day to overcool the space and provide dehumidification, as further indicated generally by block 140. In some embodiments, for example, the controller can be configured to activate the air conditioner non-stop for a first period of time between 2 pm to 4 pm, and again at a second period of time between 9 pm and 11 pm each day. The duration that the air conditioner activates during the first and/or second periods may vary depending on factors such as the inside temperature, the outside temperature, the outdoor humidity, as well as other factors. The number of activation periods, the activation times, and/or the duration of each activation period may be varied, if desired.

FIGS. 9A-9H are screen-shots showing an illustrative thermostat 142 having an away mode of operation for providing dehumidification control within an interior space, similar to that described above with respect to FIG. 2. As depicted in a first view in FIG. 9A, the thermostat 142 can include a touchscreen 144 adapted to display various status information regarding the current settings of the thermostat 142 as well as information regarding the interior and exterior environment. In a normal mode of operation shown in FIG. 9A, for example, the thermostat 142 can be configured to display a current temperature indicator 146 indicating the actual temperature within the interior space, and a setpoint temperature indicator 148 indicating the current temperature setpoint of the thermostat 142. The thermostat 142 can also be configured to display a fan setting indicator 150 on the touchscreen 144 indicating the current fan setting used by the thermostat 142, and a system setting indicator 152 indicating whether the system is currently set to cool or heat the interior space.

A number of icon buttons 154,156,158,160,162 displayed on the touchscreen 144 can be utilized to access other functionality and/or to program other settings within the thermostat 142. A "SCHED" icon button 154, for example, can be provided to permit the user to enter setpoint parameters for operating the thermostat 142 on a setpoint schedule. Selection of the "SCHED" icon button 154, for example, may permit the user to program the thermostat 142 to operate on a user-defined schedule to vary the temperature setpoints at particular times of the day and/or for certain days of the week. A schedule status indicator 164 can be displayed on the touchscreen 144 indicating whether the thermostat 142 is currently following the schedule.

A "HOLD" icon button 156 can be provided on the touchscreen 144 to permit the user to either temporarily or permanently lock the operation of the thermostat 142 at the current setpoint temperature. A "CLOCK" icon button 158 can be provided on the touchscreen 144 to permit the user to adjust the clock and date settings of the thermostat 142, including the time of day 166 and the current day of the week 168. A "SCREEN" icon button 160 can be provided to permit the user to temporarily lock the touchscreen 144 for a period of time (e.g., 1 minute), allowing the user to clean the surface of the touchscreen 144 without affecting the settings of the thermostat 142. A "MORE" icon button 162 provided on the touchscreen 144 can be used to access other functionality of the thermostat 142, if desired. For example, the "MORE" icon button 162 can be used to display the current indoor humidity, the current outdoor humidity, the current outdoor temperature, and/or other useful information.

The thermostat 142 can include a configuration routine for programming various settings related to the away mode of operation, similar to that described above with respect to FIG. 4. Initiation of the configuration routine can be accomplished, for example, by the installer depressing the system setting indicator 152 on the touchscreen 144 one or more times until the text "cool" blinks on the screen, and then selecting icon buttons 156 and 160 together on the touchscreen 144. Initiation of the configuration routine can be accomplished using other sequences of keystrokes on the touchscreen 144, however, or can be accomplished remotely from another device in communication with the thermostat 142. Since the initiation of the configuration routine requires some prior knowledge of the sequence of buttons or keystrokes, the occupant is prevented from unintentionally changing the away mode settings during normal operation of the thermostat 142.

Figure 9A:
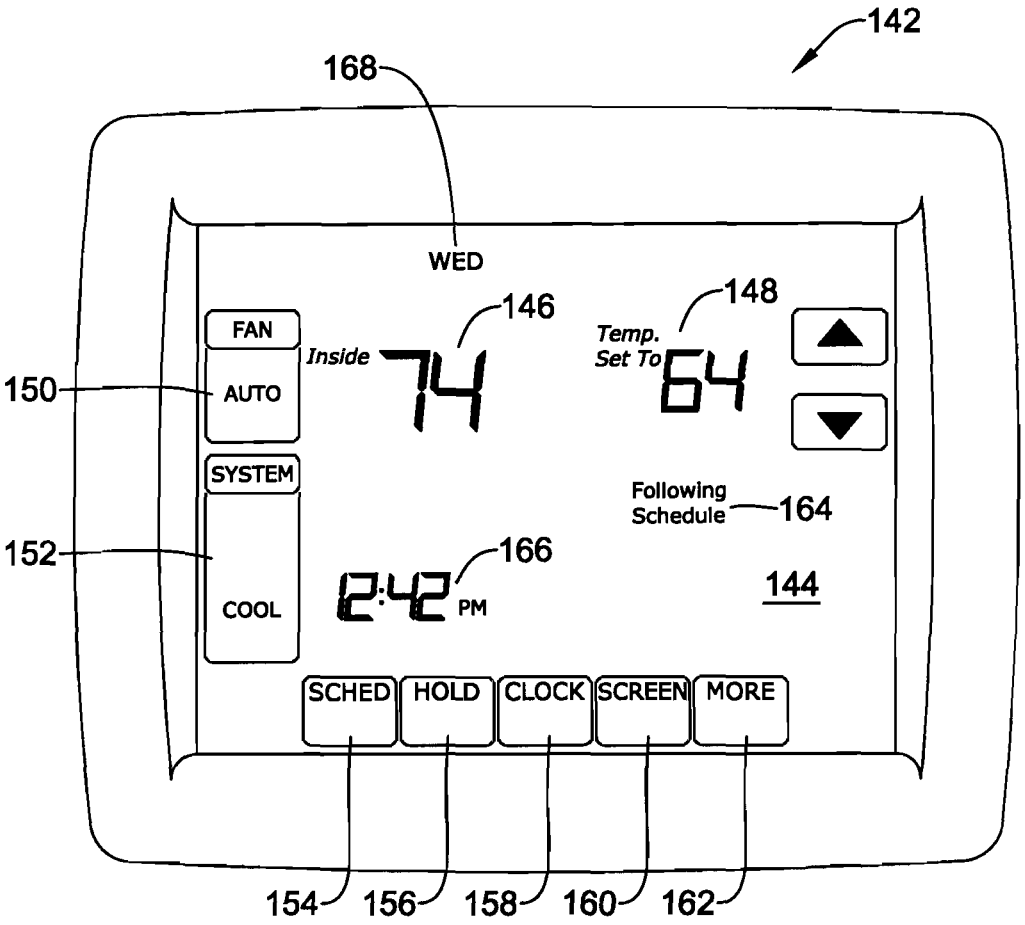
FIGS. 9A-9H are screen-shots showing an illustrative thermostat having an away mode of operation for providing dehumidification control within an interior space.
Figure 9B:
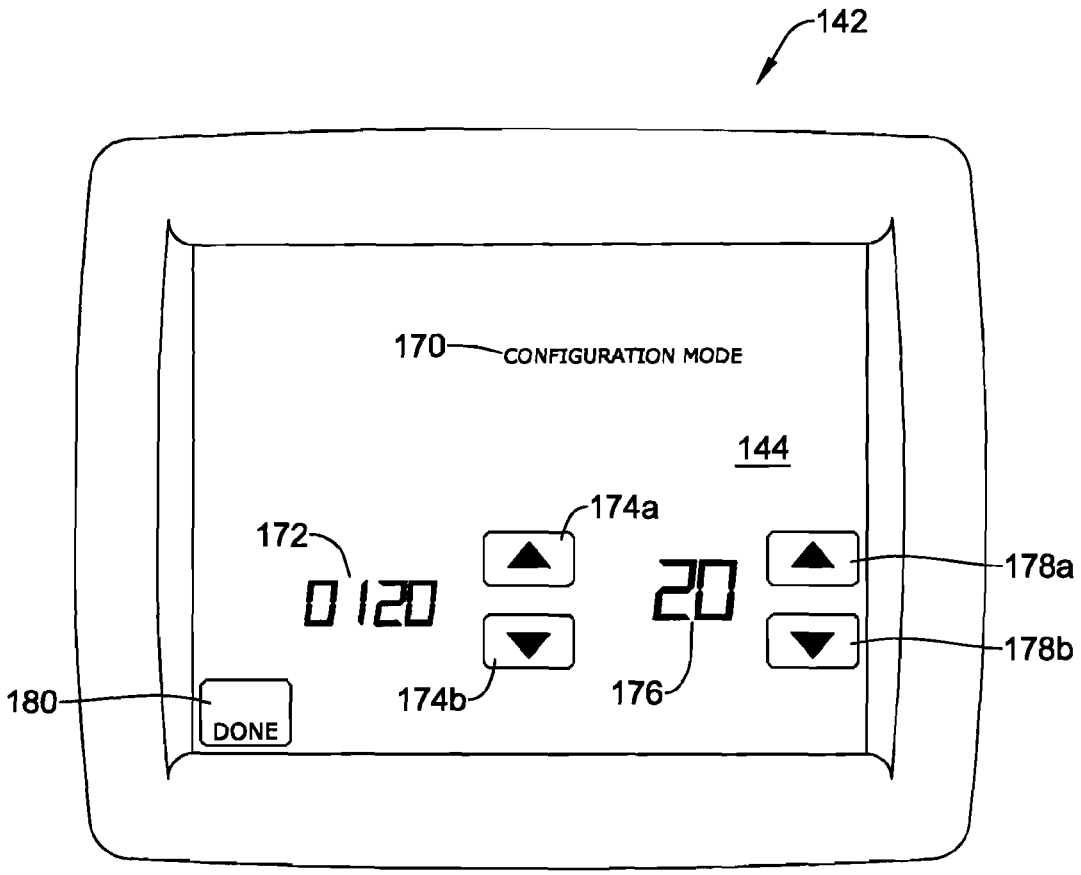

When initiated, and as shown in a second screen shot in FIG. 9B, the thermostat 142 can be configured to display the text 170 "CONFIGURATION MODE" on the touchscreen 144, informing the installer that the configuration mode has been activated. The thermostat 142 can remove status information such as the current temperature, time, day of week, etc. from the touchscreen 144, thus simplifying the configuration process.

As further shown in FIG. 9B, the thermostat 142 can be configured to display an installer set up (ISU) programming code 172 on the touchscreen 144 along with a set of up/down arrow buttons 174*a*,174*b*. The programming code 172 displayed on the touchscreen 144 may relate to a unique code that can be used to program the thermostat 142. For each programming code 172, the thermostat 142 can be configured to display a corresponding setting 176 on the touchscreen 144, which can be adjusted using a second set of up/down arrow buttons 178*a*,178*b* provided on the touchscreen 144. If, for example, the programming code "0120" in FIG. 9B corresponds to the first two digits of the year to be programmed, the thermostat 142 can be configured to display a setting 176 of "20" for those years beginning with "20" (e.g., 2006). The settings for that particular programming code 172 can then be adjusted, if necessary, using the up/down arrow buttons 178*a*,178*b*. A "DONE" icon button 180 on the touchscreen 144 can be selected at any time during programming to store the current settings and return the thermostat 142 back to its normal operating mode.

FIGS. 9C-9H are screen shots showing several illustrative steps of configuring the away mode settings within the thermostat 142 using the touchscreen 144. FIGS. 9C-9H may be understood in conjunction with the table of FIG. 10, which shows several illustrative programming codes for configuring the thermostat 142 to function in the away mode of operation, including those programming codes for selecting the dehumidification away mode, the away fan setting, the away low temperature limit setpoint, the away temperature setpoint, and the away dehumidification setpoint.

Figure 9C:
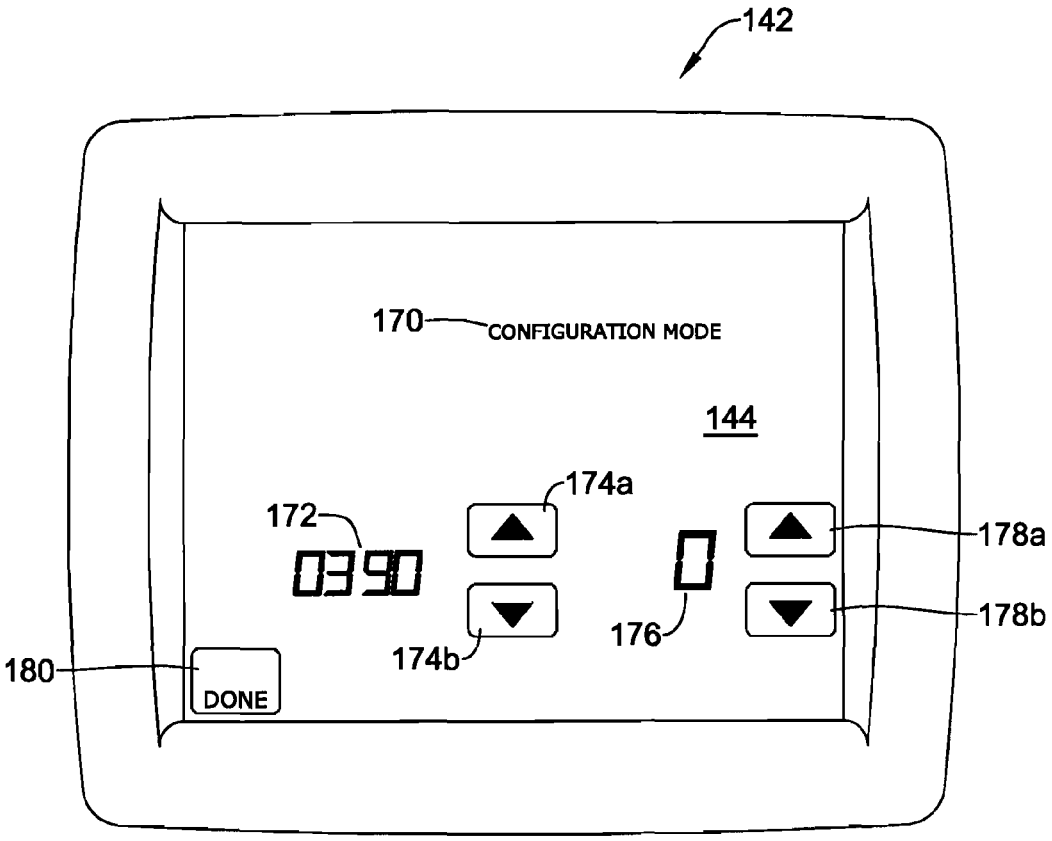
Figure 9D:
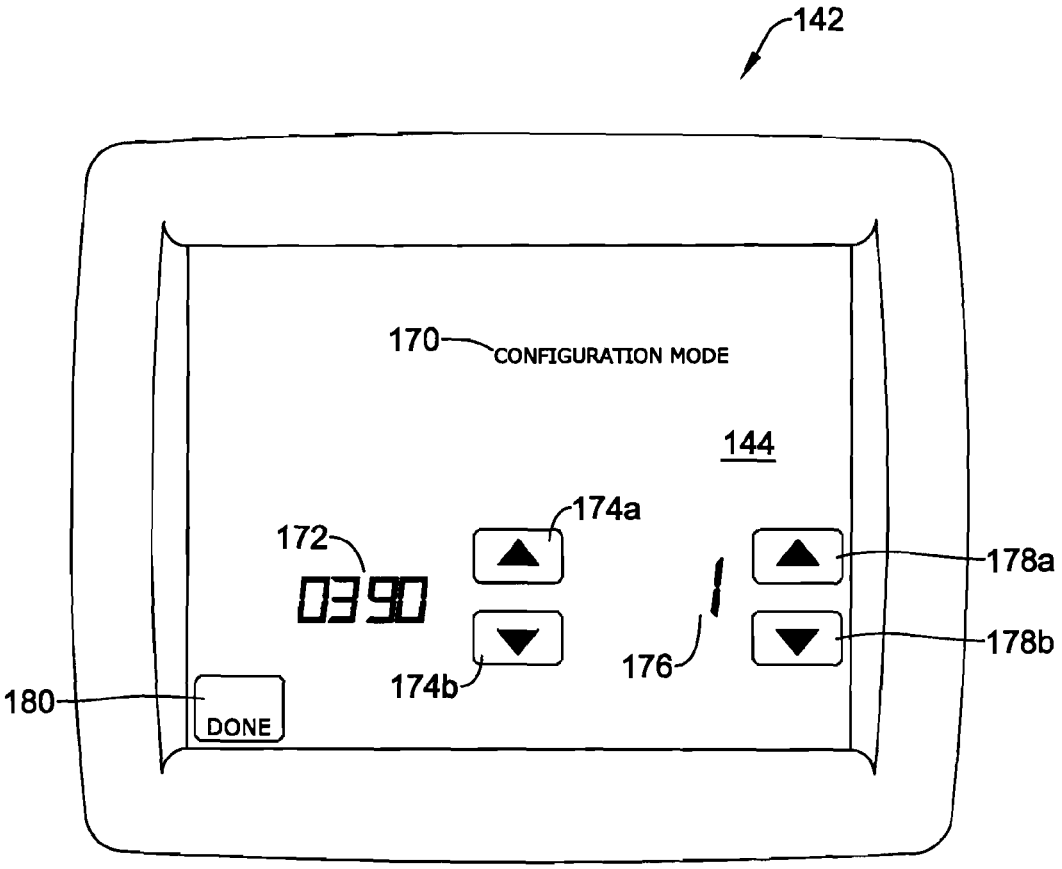

To configure the thermostat controller 142 to operate in the away mode, and as further shown in FIG. 9C, the installer may select a programming code 172 of "0390" using the up/down arrow buttons 174*a*,174*b* provided on the touchscreen 144, causing the thermostat 142 to display a default setting of "0" on the touchscreen 144 indicating that the away mode is currently disabled. If the installer desires to enable the dehumidification away mode, the installer may then depress the appropriate up/down arrow button 178*a*, 178*b* to display the "1" setting on the touchscreen 144, as shown in FIG. 9D. Alternatively, if the installer desires to disable the dehumidification away mode, the installer may keep the current setting of "0" and then press the "DONE" icon button 180 on the touchscreen 144, causing the thermostat 142 to disable the away mode and exit the configuration routine.

Figure 9E:
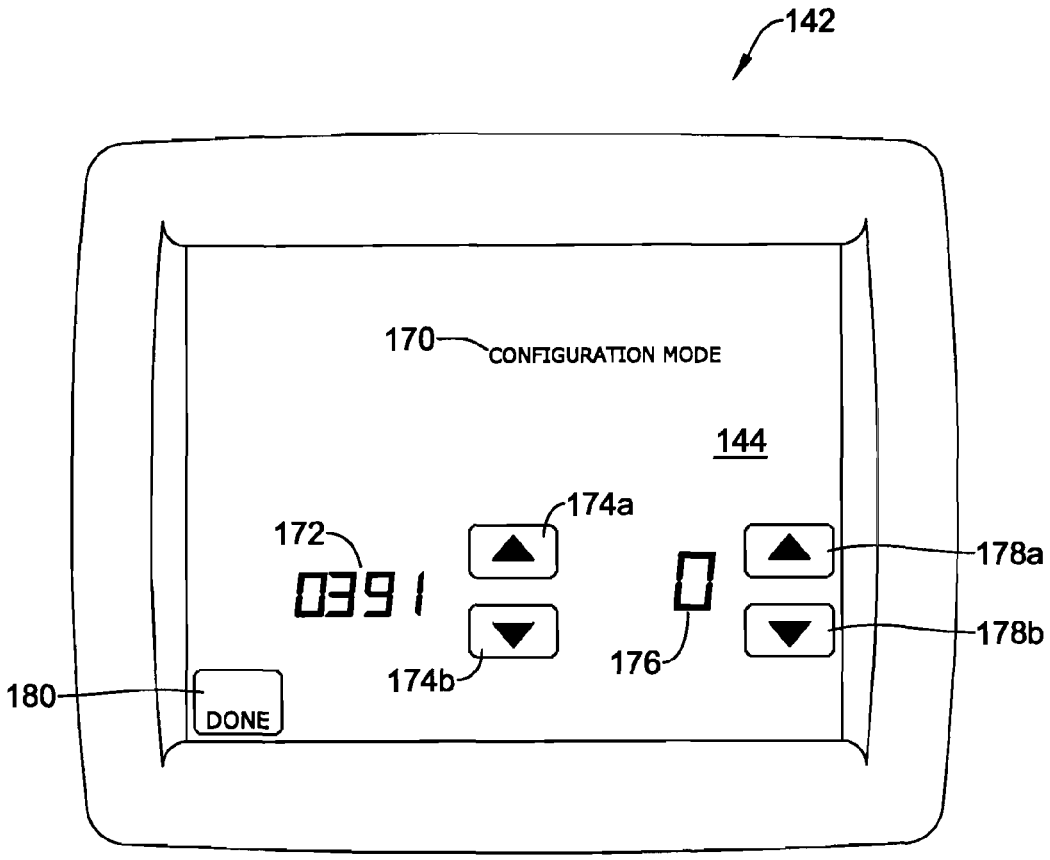

To configure the fan setting to be used during the away mode of operation, the installer may select the appropriate programming code 172 (i.e. "0391") using the first set of up/down arrow buttons 174*a*,174*b*, and then enter the desired code using the second set of up/down arrow buttons 178*a*,178*b*, as shown in FIG. 9E. The thermostat 142 can be configured to provide a default setting of "0", corresponding to an away fan setting of "auto". If the installer desires to alter this setting to operate the system fan in a different mode such as "on" or "circulate", the installer may select the up/down arrow buttons 178*a*,178*b* one or more times to display the desired setting 176 on the touchscreen 144. If, for example, the installer desires to operate the system fan in an "on" mode to operate the fan continually during the away mode, the installer may select a setting of "1" on the touchscreen 144 using the up/down arrow buttons 178*a*, 178*b*. Alternatively, if the installer desires to operate the fan in a "circulation" mode during the away mode, the installer may select a setting 176 of "2" on the touchscreen 144 using the up/down arrow buttons 178*a*,178*b*.

Figure 9F:
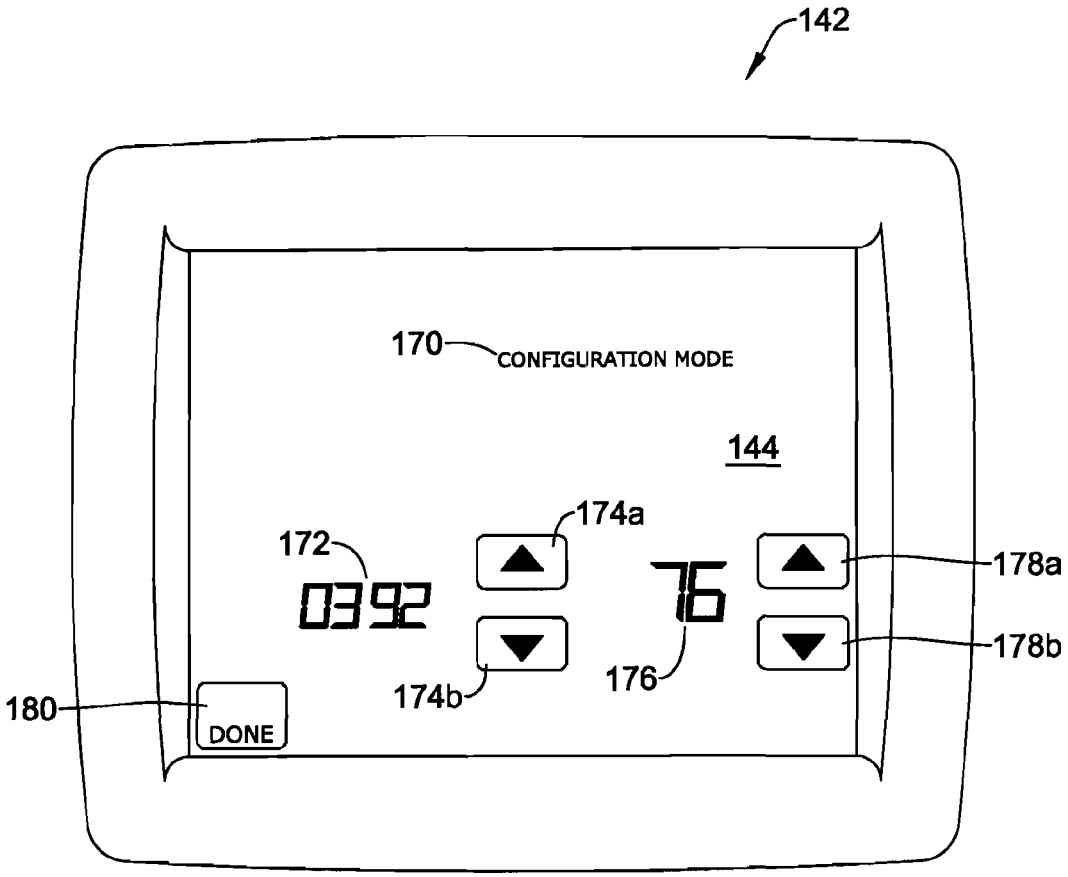

To configure the low temperature limit setpoint to be used during the away mode, and as further shown in FIG. 9F, the installer may select the appropriate programming code (i.e. "0392") on the touchscreen 144, causing the thermostat 142 to display a default value (e.g., "76° F.") for that setting. If the installer accepts the current setpoint, the installer may then select the next programming code to be configured; otherwise the installer may change the setpoint using the up/down arrow buttons 178*a*,178*b* on the touchscreen 144.

If, for example, the installer desires to change the low temperature limit setpoint to a different value such as 78° F., the installer may depress the up arrow button 178*a* two times until a setting 176 of "78" is displayed on the touchscreen 144.

Figure 9G:
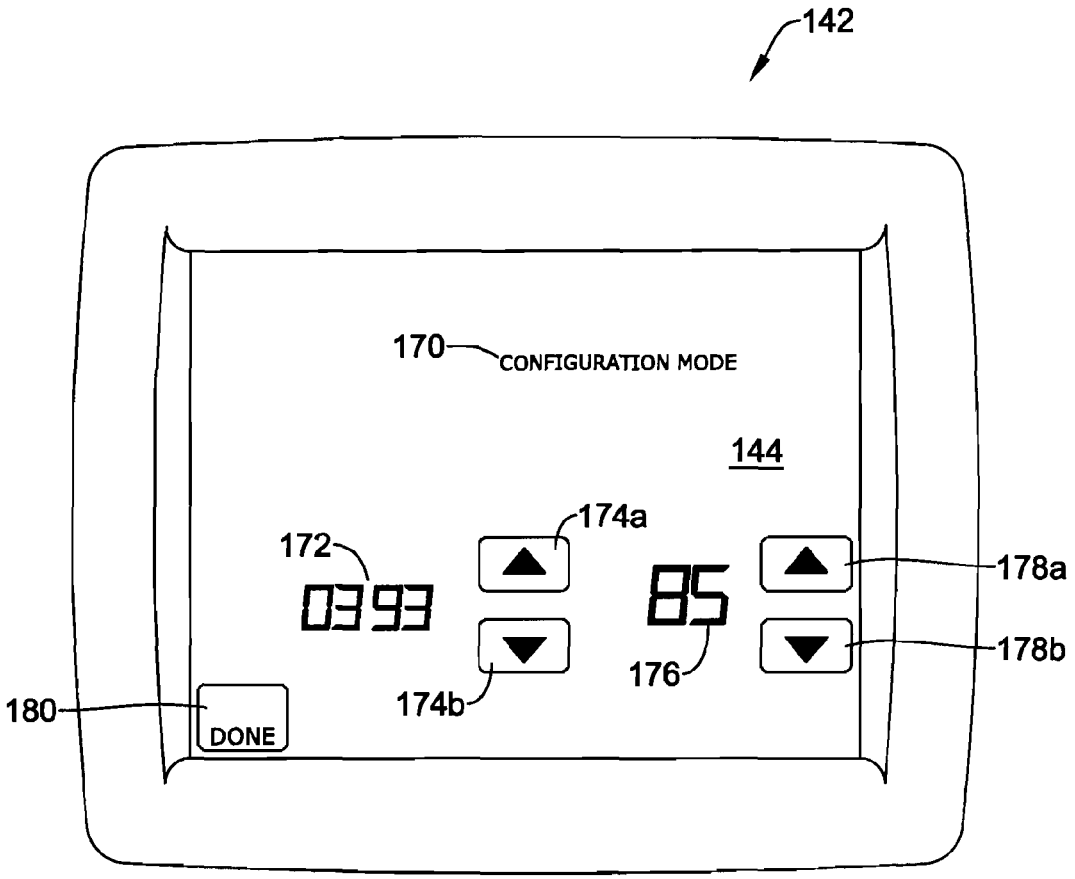

To configure the dehumidification away temperature setpoint to be used during the away mode, and as further shown in FIG. 9G, the installer may select the appropriate programming code (i.e. "0393") using the up/down arrow buttons 174, causing the thermostat 142 to display a default value (e.g., "85° F.) for that setting. If the installer accepts the current setpoint, the installer may then select the next programming code to be configured; otherwise the installer may change the setpoint using the up/down arrow buttons 178*a*,178*b* on the touchscreen 144. If, for example, the installer desires to change the away temperature setpoint to a different value such as 83° F., the installer may depress the down arrow button 178 two times until a setting 176 of "83" is displayed on the touchscreen 144.

Figure 9H:
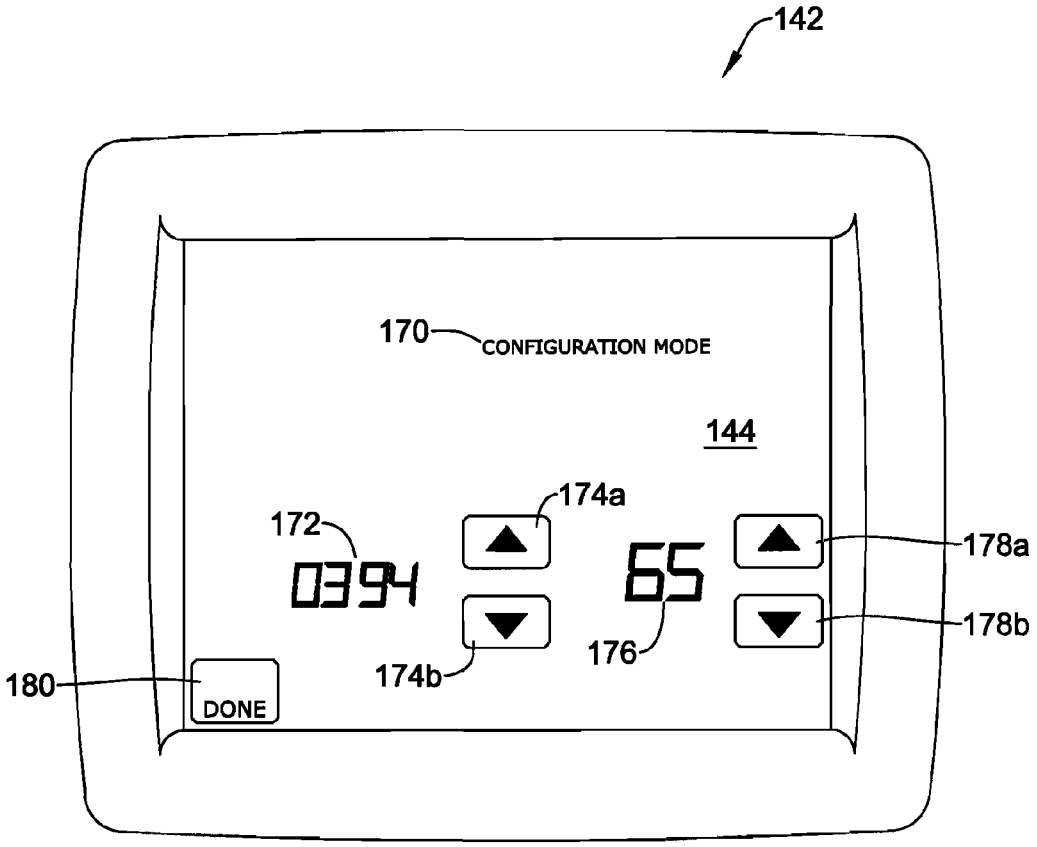

To configure the away dehumidification setting to be used during the away mode, and as further shown in FIG. 9H, the installer may select programming code "0394" on the touchscreen 144, causing the thermostat 142 to display a default value (e.g., 65%") for that setpoint. The installer may then accept the current setting, or, alternatively, may change the setting using the up/down arrow buttons 178 on the touchscreen 144.

Once the installer has finished programming the various away mode settings, the installer may then select the "DONE" icon button 180 on the touchscreen 144, causing the thermostat 142 to store the settings and resume normal thermostat operation.

Figure 11A:
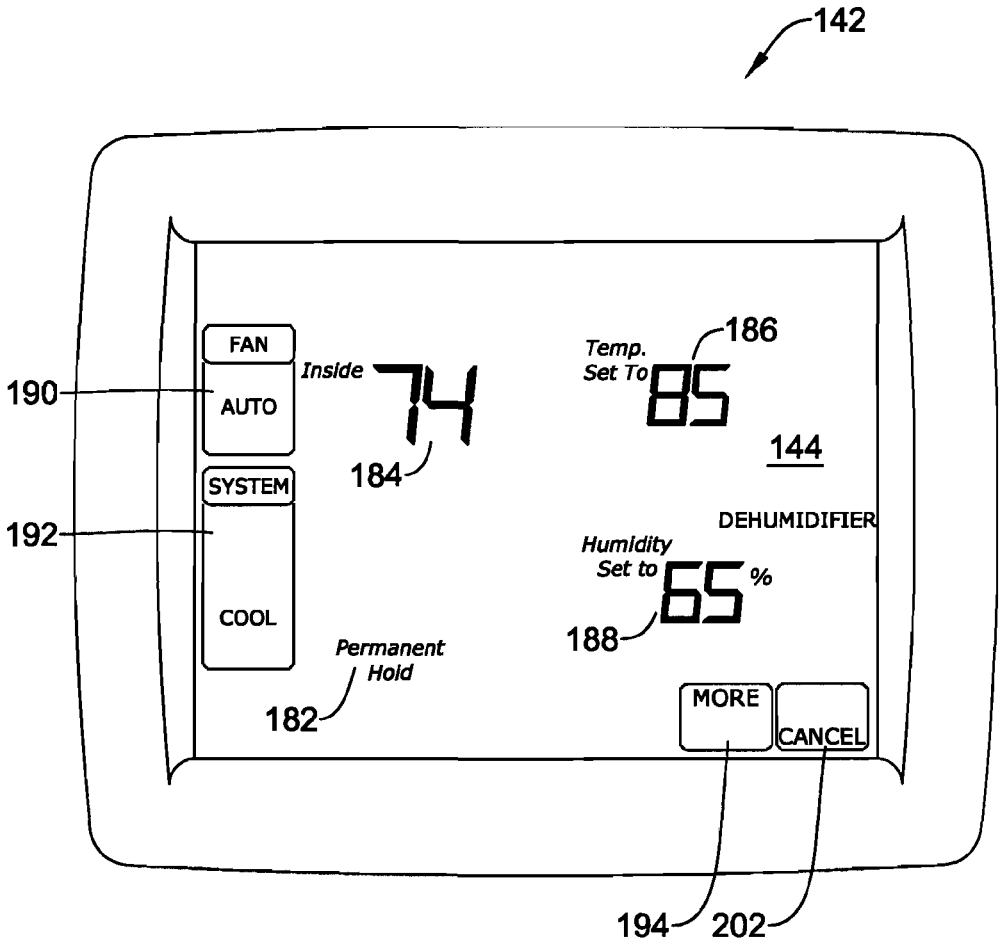
FIGS. 11A-11B are screen-shots showing several illustrative steps of activating the dehumidification away mode within the thermostat of FIG. 9.
Figure 11B:
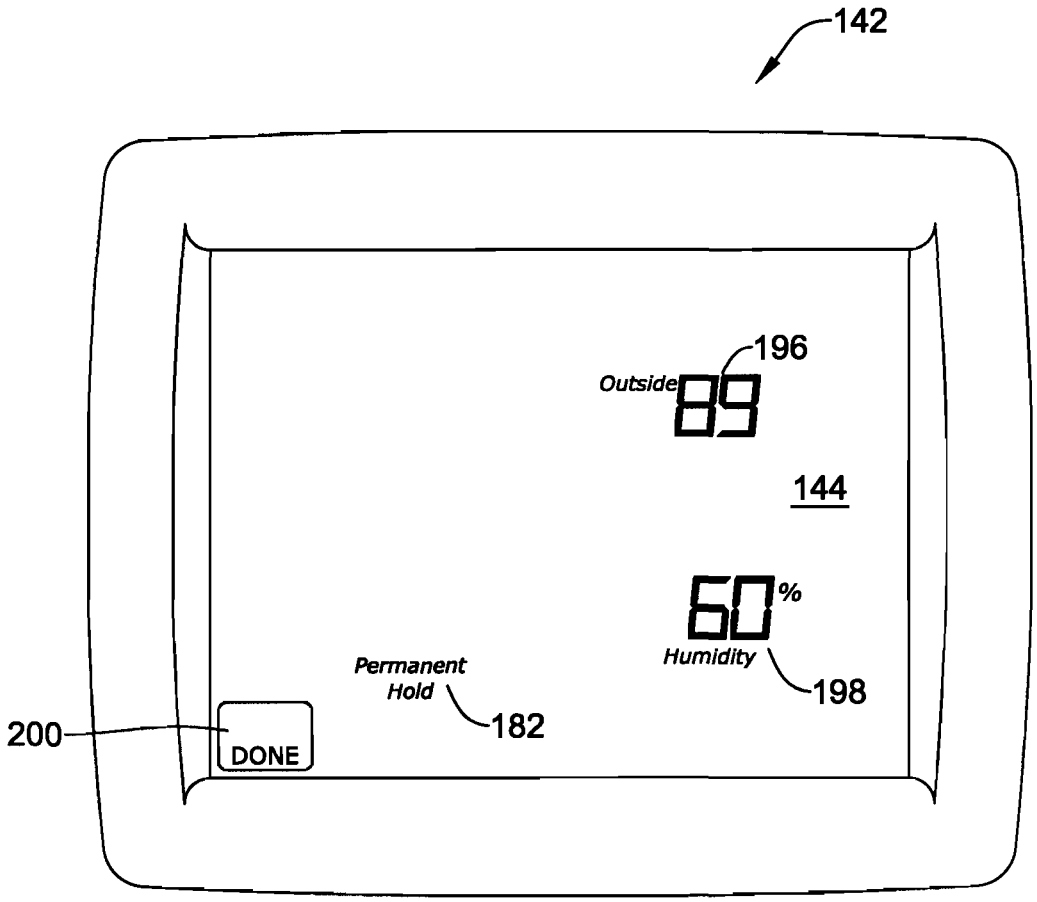

FIGS. 11A-11B are screen shots showing several illustrative steps of activating the dehumidification away mode within the thermostat 142. To activate the dehumidification away mode while in the normal operating mode depicted, for example, in FIG. 9A, the user may depress the "HOLD" icon button 156 on the touchscreen 144 three times or, alternatively, perform some other sequence of keystrokes, causing the thermostat 142 to switch to the away mode and operate using the away mode settings.

As shown in FIG. 11A, once the user initiates the away mode of operation, the thermostat 142 can be configured to display the text 182 "PERMANENT HOLD" on the touchscreen 144, informing the user that the thermostat 142 is currently operating in the away mode of operation. When initiated, the thermostat 142 can be configured to display an inside temperature indicator 184 indicating the current inside temperature within the interior space, an away temperature setpoint indicator 186 indicating the current away temperature setpoint used for controlling the temperature within the interior space, and an away dehumidification setpoint indicator 188 indicating the current away dehumidification setpoint used for controlling the humidity within the interior space. A fan setting indicator 190 can be displayed on the touchscreen 144 indicating the current away fan setting used by the thermostat 142. A system indicator 192, in turn, can be configured to display "cool" on the touchscreen 144, indicating that the thermostat 142 is currently set to cool the interior space.

A "MORE" icon button 194 on the touchscreen 144 can be used to gain access to other information while the thermostat 142 is operating in the away mode. As shown in a second screen shot in FIG. 11B, for example, selection of the "MORE" icon button 194 can cause the thermostat 142 to display an outside temperature indicator 196 indicating the current outside temperature, and an indoor humidity indicator 198 indicating the current indoor humidity level within the interior space. Once the user is finished viewing this additional information, the user may depress a "DONE" icon button 200 on the touchscreen 144, causing the thermostat 142 to revert back to the away mode screen shown in FIG. 11A.

If at any time the user desires to exit the away mode of operation and revert back to normal thermostat operation, the user may select a "CANCEL" icon button 202 on the away mode screen depicted in FIG. 11A. When selected, the thermostat 142 can be configured to recall the setpoint parameters used during normal thermostat operation and control the system based on those parameters to provide cooling and/or heating within the controlled space.

Although the illustrative thermostat 142 depicted in FIGS. 9 and 11 includes a touchscreen interface 144, it should be understood that other types of user interfaces could also be provided. In one alternative embodiment, for example, a thermostat equipped with an away mode of operation can employ a fixed segment display panel along with a keypad or other suitable means for entering commands and/or settings into the thermostat.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention.

What is claimed is:

1. A method of providing dehumidification control within the interior space of a building or room that is unoccupied for an extended period of time, the method comprising the steps of:

providing a controller in communication with an air conditioner, the controller having a normal schedule cooling mode of operation that includes a home period and an away period, each period having a number of cooling mode settings, the controller further having an extended away cooling mode of operation having a number of extended away cooling mode settings that are configured to conserve energy relative to the cooling mode settings of the home and/or away periods of the normal schedule cooling mode of operation, the extended away cooling mode of the controller configured to control the air conditioner for providing dehumidification within the interior space while the building or room is unoccupied for an extended period of time;

configuring the number of extended away cooling mode settings within the controller for controlling the environment within the interior space during the extended away cooling mode of operation, the extended away cooling mode settings including an extended away dehumidification setting and an extended away temperature setting;

initiating the extended away cooling mode of operation within the controller; and when in the extended away cooling mode of operation, operating the air conditioner to:

maintain the temperature within the interior space at or below said extended away temperature setting by selectively activating the air conditioner; and maintain the humidity within the interior space at or below said extended away dehumidification setting by selectively activating the air conditioner, even when the temperature of the interior space is less than the extended away temperature setting.

2. The method of claim 1, further comprising:

determining whether an indoor dewpoint temperature within the interior space is greater than an extended away cooling low temperature limit setting;

operating the air conditioner to cool the interior space using a measure related to the indoor dewpoint temperature as a set point if the indoor dewpoint temperature is greater than the extended away cooling low temperature limit setting; and operating the air conditioner to cool the interior space using a measure related to the extended away cooling low temperature limit setting as the set point if the indoor dewpoint temperature is at or below the extended away cooling low temperature limit setting, and the humidity within the interior space is above the extended away dehumidification setting.

3. The method of claim 1, further comprising:

determining whether the indoor humidity within the interior space is greater than an extended away dehumidification setting;

selectively operating the air conditioner to control the temperature in the interior space using a measure related to an extended away cooling temperature setting as a set point when the indoor humidity is less than the extended away dehumidification setting; and selectively operating the air conditioner to control the humidity in the interior space using a measure related to the extended away cooling low temperature setting as a set point if the indoor humidity is greater than the extended away dehumidification setting.

4. The method of claim 3, further comprising:

determining a dewpoint within the interior space; and selectively operating the air conditioner to control the humidity in the interior space using a measure related to the dewpoint when the dewpoint is higher than an extended away cooling low temperature setting.

5. The method of claim 1, wherein the controller is a thermostat.

6. The method of claim 5, wherein the controller is a programmable residential thermostat.

7. The method of claim 6, wherein the home period of the normal schedule cooling mode of operation includes one or more of a wake period, a return and a sleep period.

8. The method of claim 6, wherein the away period of the normal schedule cooling mode of operation includes a leave period.

9. A method of providing temperature and humidity control within the interior space of a building via a controller in communication with an air conditioner, the method comprising the steps of:

storing an extended away cooling temperature setting, an extended away cooling low temperature limit setting, and an extended away dehumidification setting within the controller;

determining whether the indoor humidity within the interior space is greater than the extended away dehumidification setting;

selectively operating the air conditioner to control the temperature in the interior space using the extended away cooling temperature setting as a set point when the indoor humidity is less than the extended away dehumidification setting; and selectively operating the air conditioner to control the humidity in the interior space using the extended away cooling low temperature limit setting as a set point if the indoor humidity is greater than the extended away dehumidification setting.

10. The method of claim 9, further comprising:

determining a dewpoint within the interior space; and selectively operating the air conditioner to control the humidity in the interior space using a measure related to the dewpoint when the dewpoint is higher than the extended away cooling low temperature limit setting.

11. The method of claim 10, further comprising:

determining whether the dewpoint temperature within the interior space is greater than the extended away cooling low temperature limit setting;

operating the air conditioner to cool the interior space using the indoor dewpoint temperature as a set point if the indoor dewpoint temperature is greater than the extended away cooling low temperature limit setting; and operating the air conditioner to cool the interior space using the extended away cooling low temperature limit setting as the set point if the indoor dewpoint temperature is at or below the extended away cooling low temperature limit setting, and the humidity within the interior space is above the extended away dehumidification setting.

12. The method of claim 9, wherein the controller is a thermostat.

13. The method of claim 12, wherein the controller is a programmable residential thermostat.

14. An HVAC controller configured to communicate with and control one or more components of an HVAC system including an air conditioner, the controller comprising:

a user interface including a display;

a memory for storing extended away cooling mode settings;

an I/O block for receiving one or more signals from the HVAC system and for providing one or more control signals to the HVAC system; and a controller coupled to the memory, the user interface and the I/O block, wherein the controller is configured to operate in a normal schedule cooling mode of operation that includes a home period and an away period, each of the home period and the away period having one or more cooling mode settings, the controller is further configured to operate in an extended away cooling mode of operation that references the extended away cooling mode settings in the memory, which are configured to conserve energy relative to the cooling mode settings of the home and/or away periods of the normal schedule cooling mode of operation, the extended away cooling mode settings including an extended away dehumidification setting and an extended away temperature setting, the extended away cooling mode of the controller configured to control the air conditioner for providing dehumidification within the interior space while the building or room is unoccupied for an extended period of time;

wherein when in the extended away cooling mode of operation, the controller is configured to operate the air conditioner to:

maintain the temperature within the interior space at or below said extended away temperature setting by selectively activating the air conditioner; and maintain the humidity within the interior space at or below said extended away dehumidification setting by selectively activating the air conditioner, even when the temperature of the interior space is less than the extended away temperature setting.

* * * * *